US007438141B2

(12) United States Patent
Hinshaw et al.

(10) Patent No.: US 7,438,141 B2
(45) Date of Patent: Oct. 21, 2008

(54) AUTOMATED, LOW PROFILE DRILLING/BOLTING MODULE WITH CAROUSEL

(75) Inventors: Gregory E. Hinshaw, Proctorville, OH (US); Henry E. Wilson, Ironton, OH (US); Craig M. Collins, Proctorville, OH (US); William A. Kyslinger, Culloden, WV (US); William B. Schwab, Ironton, OH (US)

(73) Assignee: J.H. Fletcher & Co., Huntington, WV (US)

( * ) Notice: Subject to any disclaimer, the term of this patent is extended or adjusted under 35 U.S.C. 154(b) by 0 days.

(21) Appl. No.: 11/505,955

(22) Filed: Aug. 17, 2006

(65) Prior Publication Data

US 2006/0272862 A1 Dec. 7, 2006

Related U.S. Application Data

(63) Continuation of application No. PCT/US2006/021918, filed on Jun. 5, 2006.

(60) Provisional application No. 60/687,649, filed on Jun. 3, 2005, provisional application No. 60/752,512, filed on Dec. 21, 2005.

(51) Int. Cl.
*E21B 19/00* (2006.01)
*E21D 20/00* (2006.01)

(52) U.S. Cl. ..... 175/52; 175/85; 405/259.1; 405/303

(58) Field of Classification Search ..... 175/52, 175/85; 405/259.1, 303
See application file for complete search history.

(56) References Cited

U.S. PATENT DOCUMENTS

| | | | | | |
|---|---|---|---|---|---|
| 3,218,893 | A | | 11/1965 | Madison et al. | |
| 3,670,830 | A | | 6/1972 | Van Der Wijden | |
| 3,902,561 | A | | 9/1975 | Friberg et al. | |
| 4,105,081 | A | | 8/1978 | Perraud | |
| 4,226,290 | A | * | 10/1980 | McSweeney | 175/320 |
| 4,226,559 | A | | 10/1980 | Prebensen | |
| 4,229,124 | A | | 10/1980 | Frey et al. | |
| 4,398,850 | A | | 8/1983 | Talvensaari | |
| 4,420,277 | A | | 12/1983 | Hibbard et al. | |
| 4,449,592 | A | * | 5/1984 | Mayer | 175/52 |
| 4,473,325 | A | | 9/1984 | Beney et al. | |
| 4,881,604 | A | * | 11/1989 | Orthwein | 173/11 |
| 5,114,279 | A | | 5/1992 | Bjerngren et al. | |
| 5,263,545 | A | * | 11/1993 | Tudora et al. | 175/52 |
| 5,387,736 | A | * | 2/1995 | Salomone et al. | 588/249 |
| 5,556,235 | A | | 9/1996 | Morrison et al. | |
| 5,597,267 | A | | 1/1997 | Morrison et al. | |
| 5,631,160 | A | * | 5/1997 | Bruso | 435/262.5 |
| 5,720,582 | A | | 2/1998 | Morrison et al. | |
| 5,794,721 | A | | 8/1998 | Clonch et al. | |

(Continued)

*Primary Examiner*—Giovanna C Wright
(74) *Attorney, Agent, or Firm*—King & Schickli, PLLC

(57) ABSTRACT

A module and related methods of use in drilling a borehole in a face of a mine passage using a drilling element and installing a bolt in the borehole once formed. The module may include a bolt holder for holding a plurality of bolts and a drilling element holder for holding a plurality of different drilling elements. A manipulator moves along an arcuate path between the bolt and drilling element holders to deliver the respective components to a drill head positioned along the arcuate path. The drill head may also slide relative to the mast in two different directions, and includes a drill guide for determining the location of the face to be worked.

29 Claims, 19 Drawing Sheets

U.S. PATENT DOCUMENTS 5,795,107 A 8/1998 Edmondson et al.
6,056,481 A 5/2000 Watermann et al.
6,135,674 A * 10/2000 Neilson ..... 405/259.1
6,179,065 B1 * 1/2001 Payne et al. ..... 175/24
6,413,019 B1 7/2002 Coombs et al.
6,447,210 B1 9/2002 Coombs et al.
6,497,536 B1 12/2002 Neilson et al.
6,637,522 B2 10/2003 Wilson et al.
7,032,686 B2 4/2006 Barthomeuf et al.
2002/0036101 A1 * 3/2002 Huhdanmaki et al. ..... 175/52
2006/0272862 A1 12/2006 Hinshaw et al.
2006/0278419 A1 12/2006 Hinshaw et al.
2006/0278435 A1 12/2006 Hinshaw et al.
2006/0283614 A1 12/2006 Hinshaw et al.
2006/0283634 A1 12/2006 Hinshaw et al.
2007/0003382 A1 1/2007 Hinshaw et al.
2007/0003383 A1 1/2007 Hinshaw et al.
2007/0009332 A1 1/2007 Hinshaw et al.
2007/0098505 A1 5/2007 Hinshaw et al.

* cited by examiner

714

AUTOMATED, LOW PROFILE DRILLING/BOLTING MODULE WITH CAROUSEL

This is a continuation of PCT Patent Application Ser. No. PCT/US06/21918, filed Jun. 5, 2006.

COPYRIGHT STATEMENT

A portion of the disclosure of this document contains material subject to copyright protection. No objection is made to the facsimile reproduction of the patent document or this disclosure as it appears in the Patent and Trademark Office files or records, but any and all rights in the copyright(s) are otherwise reserved.

TECHNICAL FIELD

The present inventions relate to the earth drilling or anchoring arts and, more particularly, to an automated, low profile module for drilling a borehole in a face of a narrow passage formed in the earth and installing one or more bolts therein to aid in supporting the face.

BACKGROUND OF THE INVENTION

Drills using rotatable bits for penetrating into the earth are in widespread use. One application of such drills is in connection with a machine known in the vernacular as a "roof" bolter (even though it is capable of use with faces besides the roof of a mine passage, such as the ribs.) Typically, such a roof bolter is capable of both forming (drilling) boreholes in the faces of the passageways of underground mines and then installing roof anchors or "bolts" in the boreholes. As is well-known in the art, the bolts once installed provide support for the adjacent portion of the mine face, thereby reducing the incidence of catastrophic cave-ins.

In the conventional bolting operation, once the borehole is created using the drill, the bolt in anchored in place. One way of doing so is to introduce resin or grout into the borehole, typically in cartridge form. The drill head is then used to insert a roof bolt into the borehole to rupture the resin cartridge. Once ruptured, the bolt is rotated using the drill head to mix the resin, which is designed to quickly set and form a secure bond with the material surrounding the borehole. Another manner of bolt anchorage is to use an expansion shell, various forms of which are known in the art.

One area of continuing development with relation to the roof bolting method is the step of automating the drilling of the bore hole and the insertion of the bolt into it. Originally, the operator of the roof bolting equipment worked from the mine floor operating the drill for forming the bore hole and inserting a resin cartridge and bolt by hand. Although the manual operation works well in narrow seams, it is obviously a tedious and time consuming process. Thus, significant attention has been developed to automating the process during the past fifty years. However, current automated drilling and bolting machines are not well-suited for use in the confines of a low seam environment, where the height of the mine passage is less than about six feet. Accordingly, a need is identified for an improved drilling and bolting module and, in particular, one especially adapted for use in low seam/narrow passage environments.

SUMMARY OF THE INVENTION

In accordance with one aspect of the invention, a module for use in drilling a borehole in face of a mine passage using a drilling element and installing a bolt in the borehole once formed is disclosed. The module comprises a manipulator, a bolt magazine for holding the bolt, a carousel for holding a plurality of drilling elements, and a mast carrying a drill head and a drill guide including first and second pivotally mounted arms forming a passage for receiving the drilling elements. The manipulator serially delivers the drilling elements from the drilling element holder to the drill head through the passage to form the borehole, returns the drilling elements to the drilling element holder, and associates the bolt with the drill head for installation in the borehole through the passage in the drill guide.

In accordance with a second aspect of the invention, a magazine for a plurality of bolts to be inserted in one or more faces of a mine passage is described. The magazine comprises a frame, along with first and second spaced guides supported by the frame for receiving the plurality of bolts. Each guide includes an infeed end and a delivery end. An arm pivotally mounted relative to the frame engages at least one bolt received in the guides, and is biased toward the delivery end of the guides.

In one embodiment, the biasing force for the arm is supplied by a spring. To create a low profile, the first guide preferably has a longitudinal dimension less than a corresponding dimension of the second guide, and the corresponding frame is generally trapezoidal. The magazine may also include a holder for holding the arm in a retracted position during loading of the bolts through the infeed ends of the guides. The arm may include a pivotally mounted retainer for engaging the at least one bolt, as well as a handle to facilitate manipulation. The lower guide may include flanges for supporting a plate attached to each bolt, which preferably exits the delivery end of the guides in a direction generally transverse to the longitudinal direction.

In accordance with another aspect of the invention, a manipulator is provided for gripping an object in a drilling or bolting module. The manipulator comprises an arm extending in a radial direction relative to a pivot point about which the arm is pivotally mounted for movement along a generally arcuate path. The arm carries a pair of generally opposed jaws pivotally mounted for moving between a first, closed position for gripping the object placed in close proximity to an end face of the arm and a second, open position for passing the object without any interference as the arm moves through the arcuate path and without moving in the radial direction.

In one embodiment, the end face of the arm is generally planar and the jaws in the open position each include engagement surfaces that lie in generally the same plane as the planar face of the arm. Each jaw may further include a groove in an engagement face thereof, whereby the grooves in the closed position of the jaws form a space for receiving the object.

In accordance with still another aspect of the invention, a drill steel carousel associated with a drill head comprises a rotatable body carrying a first holder for holding a first drilling element having a first bit and a second holder for holding a second drilling element having a second bit. The body may thus be rotated to present either the first drilling element or the second drilling element for insertion in the drill head for forming a borehole.

In one embodiment, each holder comprises first and second pairs of rollers spaced apart in a direction of elongation of the associated drilling element. These rollers are preferably made of a flexible material and biased toward each other to define a passage having a dimension less than a diameter of the associated drilling element. The first drilling element preferably is different from the second drilling element, such as in length or nominal diameter.

In accordance with a further aspect of the invention, a module for use in drilling into a face of a mine passage using a drilling element comprises a mast supporting a drill head for movement in a longitudinal direction and adapted for engaging the face and a drill guide comprising at least one arm having a gooseneck profile and including a passage for receiving and guiding the drilling element into engagement with the face.

Preferably, the arm with the gooseneck profile includes a first part extending in a first plane and intersecting a first axis, a second offset part extending in a second plane generally parallel to the first plane and intersecting a second axis spaced from the first axis, and a third part connecting the first and second parts. The arm also preferably includes an engagement surface for engaging the mine face. The arms may be mounted to a carriage slidably mounted along a side of the mast opposite the drill head.

In accordance with still a further aspect of the invention, a module for use in drilling into a face of a mine passage using a drilling element is disclosed. The module comprises a mast supporting a drill head for movement in a longitudinal direction and adapted for engaging the face. A drill guide comprises a pair of pivotally mounted arms forming a frustoconical passage for receiving and guiding the drilling element into engagement with the face. Preferably, the arms each include a surface for engaging the face, and a wider end of the passage is opposite the engagement surface.

In accordance with yet another aspect of the invention, a module for use in drilling into a face of a mine passage using a drilling element is disclosed. The module comprises an elongated mast having first and second guide surfaces and a drill head for receiving the drilling element and carried by the mast for movement along the first guide surface. A drill guide carried by the mast is mounted for movement along the second guide surface, and comprises a pair of pivotally mounted arms defining a passage for receiving and guiding the drilling element.

In one embodiment, the module further includes means for detecting the relative location of the face using the drill guide. Preferably, the detecting means includes a sensor for sensing a pressure associated with means for advancing the drill guide to the face. The module may also include means for detecting the contact between the drilling element and the face, as well as means for initiating a collaring routine if an output from the means for detecting the contact between the drilling element and the face indicates a lack of solid contact.

In accordance with still a further aspect of the invention, a module for use in installing a bolt into a face of a mine passage comprises a manipulator for moving along a generally arcuate path. A holder holds the bolt at a first location adjacent the arcuate path. A drill head including a chuck is positioned at a second location adjacent the arcuate path. The manipulator follows the arcuate path to transport the bolt from the holder toward the drill head.

In one embodiment, the module further includes a mast having a carriage for supporting the drill head so as to be capable of moving in a direction transverse to a direction of elongation of the mast. Consequently, the drill head can be moved away from the mast to permit insertion of the bolt into a borehole in the face by the manipulator. Preferably, the holder comprises a magazine for carrying a plurality of bolts.

In accordance with an additional aspect of the invention, a module for use in drilling a bore hole in a face of a mine passage using a drilling element comprises a manipulator arm for moving along a generally arcuate path and a holder for holding the drilling element at a first location along the arcuate path. The module further includes a drill head including a chuck positioned at a second location adjacent the arcuate path. The manipulator arm follows the arcuate path to transport the drilling element from the holder to the drill head.

In one embodiment, the module further includes a mast having a carriage for supporting the drill head so as to be capable of moving in a direction transverse to a direction of elongation of the mast. Consequently, the drill head can be moved away from the mast to permit insertion of the drilling element into a borehole in the face by the manipulator arm. Preferably, the holder comprises a carousel for holding a plurality of drilling elements.

In accordance with one more aspect of the invention, a module for use in drilling a borehole in face of a mine passage using a drilling element and installing a bolt in the borehole once formed is disclosed. The module comprises a stab jack actuated by a cylinder including a fluid under pressure for engaging a face of a corresponding mine passage to fix the position of the module relative to the mine passage, thereby helping to assure proper alignment of the machine during bolting. The improvement comprises providing a sensor for sensing the pressure of the fluid associated with the cylinder and generating an output signal, as well as a controller for automatically advancing the stab jack to engage the mine face based on an output signal change.

In accordance with still one more aspect of the invention, a module for use in drilling a borehole in face of a mine passage using a drilling element and installing a bolt in the borehole once formed is disclosed. The module comprises a drill head for advancing toward the face and computer-implemented means for causing the drill head, upon receiving a single user input signal, to use the drilling element to form the borehole and install the bolt in the borehole once formed.

In accordance with still a further aspect of the invention, a method of completing a starter borehole using a drill head for advancing along an elongated mast defining a drilling path is described. The method comprises moving the drill head away from the drilling path in a transverse direction without moving the mast. The method further comprises inserting a finishing drilling element at least partially into the starter borehole, and returning the drill head to the drilling path and advancing the drill head along the mast to advance the finishing drilling element into the borehole and form a finished borehole.

In one embodiment, the method may still further comprise moving the drill head away from the drilling path, and inserting a bolt at least partially into the finished borehole. In such case, the method may include returning the drill head to the drilling path and advancing the drill head along the mast to advance the bolt into the borehole.

In accordance with a further aspect of the invention, a method of installing a bolt in a borehole formed in a face of a mine passage using a drill head mounted for moving along a mast in a longitudinal path is disclosed. The method comprises moving the drill head in a direction transverse to the longitudinal path without moving the mast, inserting a bolt at least partially into the borehole, and returning the drill head to the drilling path and advancing the drill head along the mast to advance the bolt into the borehole. Preferably, the inserting step uses a manipulator.

In accordance with yet one more aspect of the invention, a method of drilling a borehole in face of a mine passage using a drilling element and installing a bolt in the borehole once formed using a manipulator movable along a generally arcuate path is disclosed. The method comprises moving the drilling element from a first location along the arcuate path extending in a first plane to a drilling path extending in a second plane, drilling the borehole using the drilling element, moving the bolt from a second location along the arcuate path to the drilling path, and installing the bolt in the borehole. Preferably, the drilling element comprises a starter drilling element, the drilling step comprises drilling a starter borehole, and the method comprises moving a finishing drilling element along the arcuate path to the drilling path and then finishing the borehole.

In accordance with one other aspect of the invention, a method of drilling a borehole in a face of a mine passage using a drill head associated with a drill guide is detailed. The method comprises advancing the drill guide into engagement with the face. The position of the face relative to the drill head is determined, and then the drill head is advanced toward the face a distance determined based on the detected position of the face.

Preferably, the step of advancing the drill guide is completed using a hydraulic cylinder, and determining the position of the face comprises monitoring the pressure of the cylinder and determining the presence of a pressure difference associated with the drill guide engaging the face. Likewise, the step of advancing the drill head is preferably completed using a hydraulic cylinder, and the method further comprises determining the position of a drilling element by monitoring the pressure of the cylinder and determining the presence of a pressure difference associated with the drilling element engaging the face. The method may further include the step of collaring the hole if the determining step indicates that the drilling element is not properly engaging the face.

In accordance with yet a further aspect of the invention, a method of controlling a drilling or bolting operation is described. Practice of the method comprises drilling a borehole and installing the bolt in the borehole upon receiving a single user input signal.

In accordance with another aspect of the invention, a control arrangement for a drilling or bolting module is disclosed. The control includes a first user interface including a display for displaying at least one component of the module, and a second user interface to automatically start the drilling or bolting operation. The display shows the movement of the component during the drilling or bolting operation.

Preferably, the component of the module has a color, and the display visually represents the component of the module in the same color. Still more preferably, the display displays a plurality of components of the module, each component of the module has a color, and the display visually represents the component of the module in the corresponding colors. The control arrangement may further include a third user interface to abort the drilling or bolting operation, as well as a fourth user interface for returning a component of the module to a home or safe position.

Another aspect of the invention involves in a drilling or bolting module having at least one component with a color and a control panel. The improvement comprises a first user interface including a display for displaying a representation of the component of the module in the color. Preferably, the module includes a plurality of components, each having a color, and the display visually represents the component of the module in the corresponding color.

Still another aspect of the invention relates to a control system for a drilling or bolting module having a component with at least one color and a graphical user interface including a display. This aspect is a method of displaying information comprising displaying on the display device a representation of the component having the at least one color. Preferably, the representation is of the component.

A further aspect of the invention involves a control system for a drilling or bolting module having two moving components and a graphical user interface including a display. This aspect is a method of displaying information comprising determining based on relative position whether the components are on a collision course based on user input and displaying on the display device a warning message.

BRIEF DESCRIPTION OF THE DRAWING FIGURES

Figure 1:
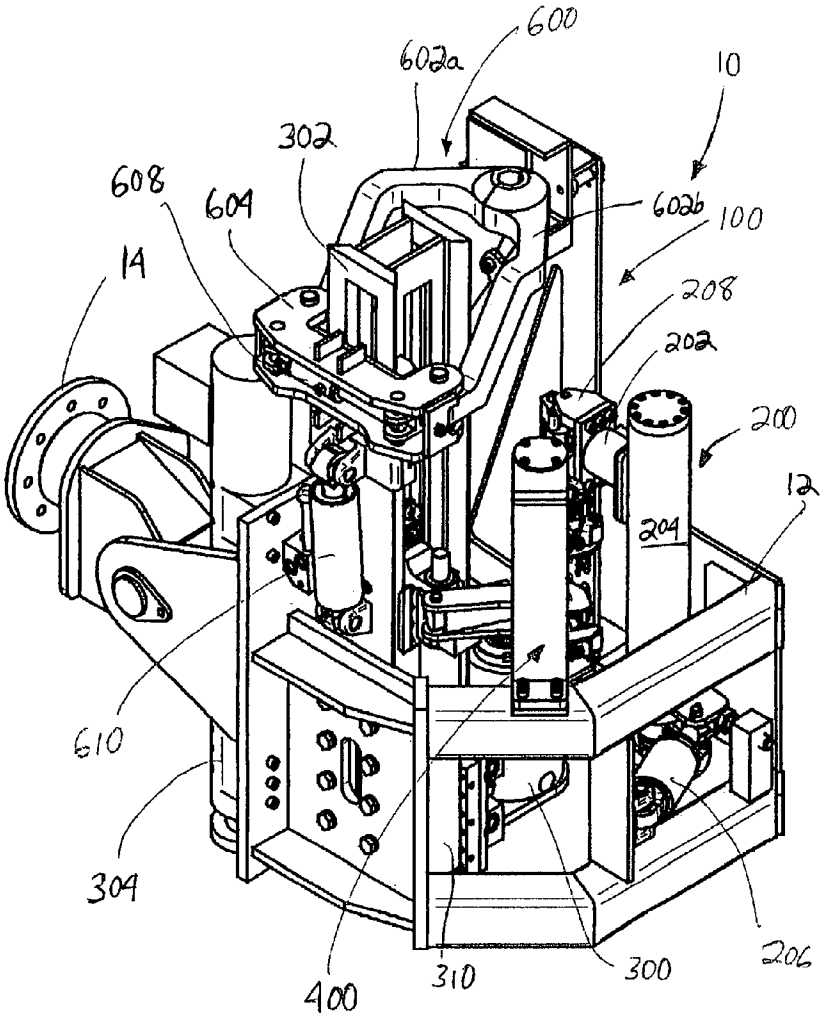
FIG. 1 is an overall perspective view of one possible embodiment of the drilling or bolting module.
Figure 5:
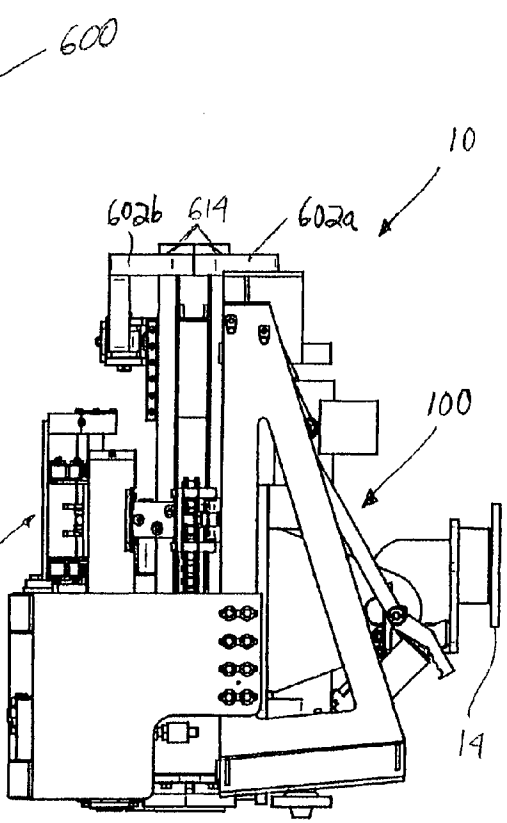
Figure 12:
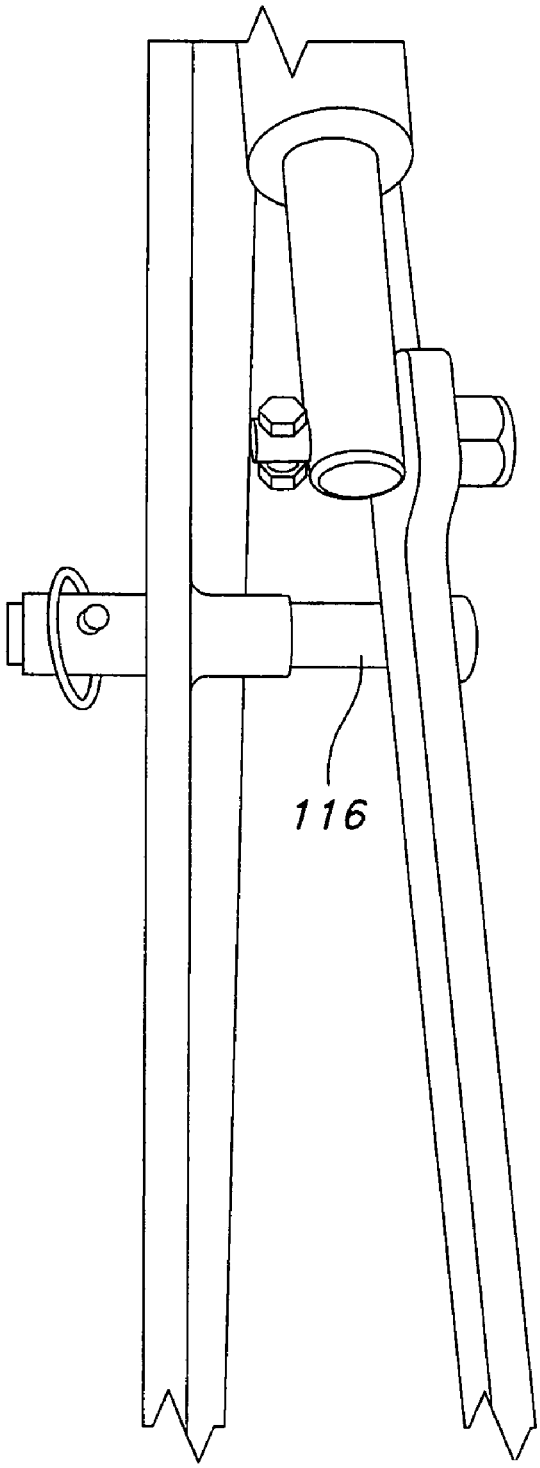
Figure 13:
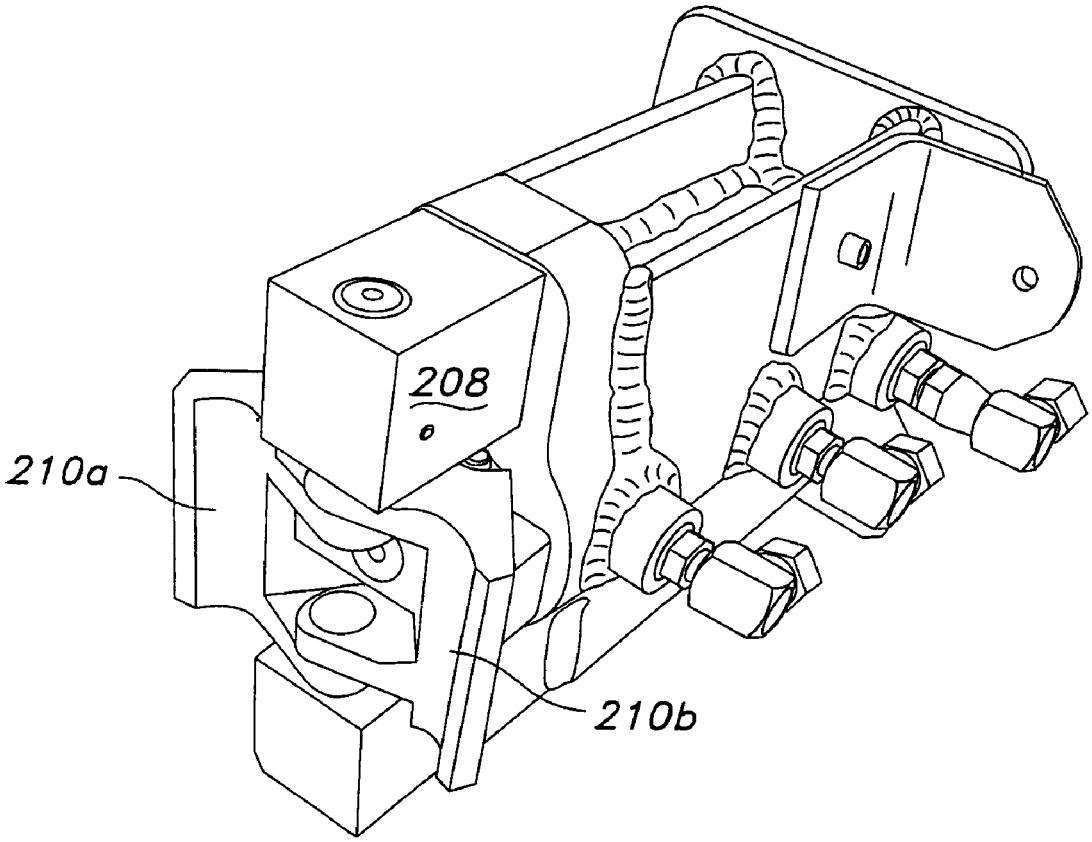
Figure 14:
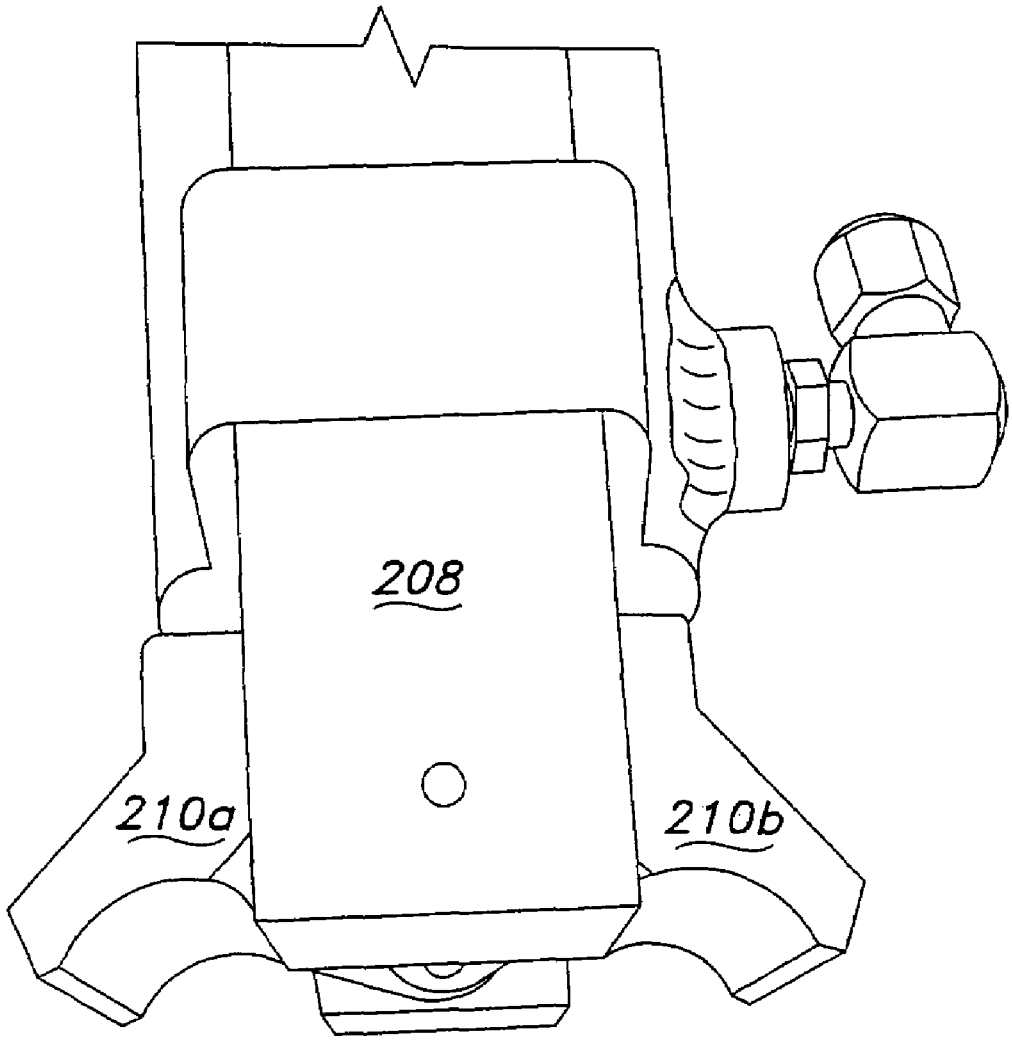
Figure 15A:
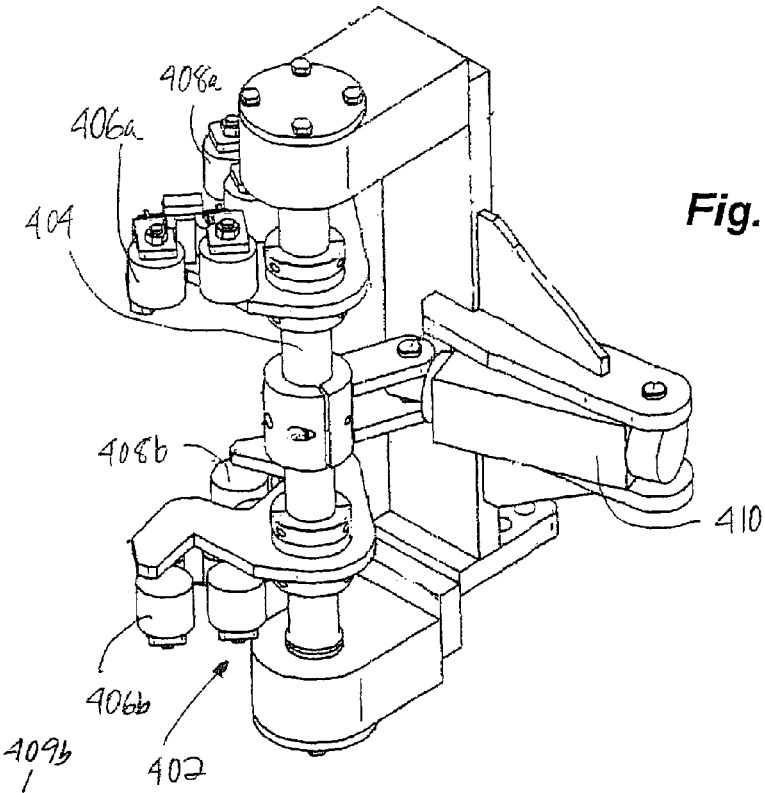
Figure 15B:
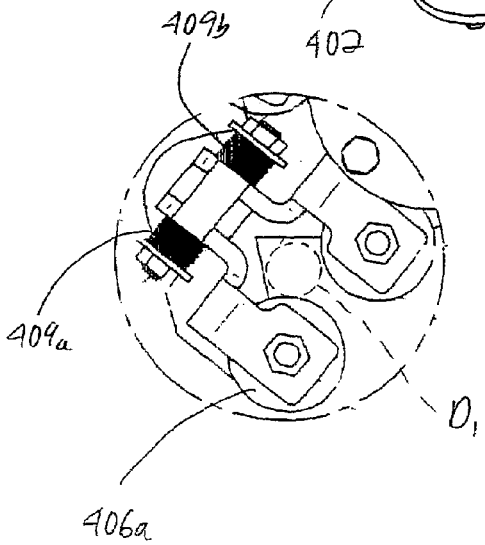
Figure 15C:
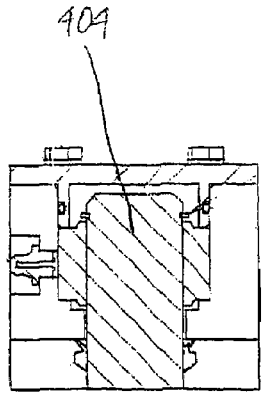
Figure 16A:
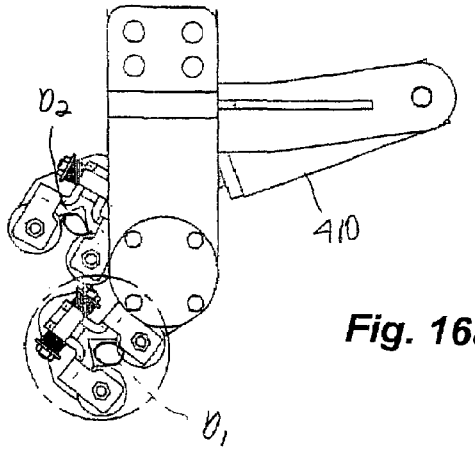
Figure 16B:
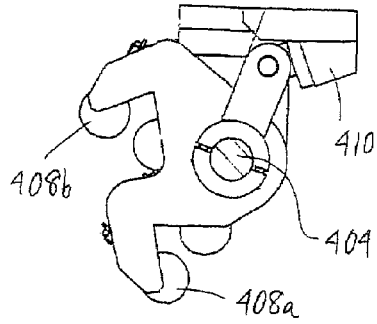
Figure 16C:
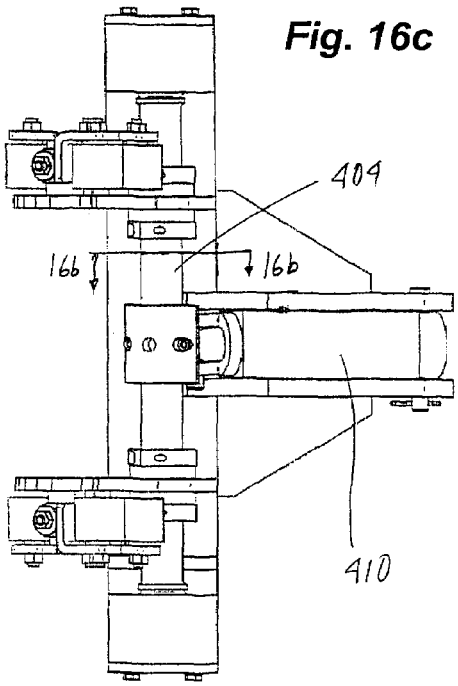
Figure 16D:
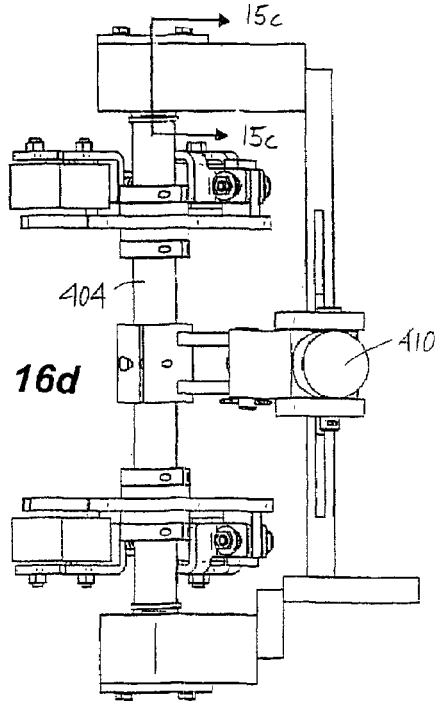

FIGS. 3, 4, 5, and 5*a* represent side views of the module of FIG. 1;

FIGS. 6-12 are side views of one embodiment of a bolt magazine, both with and without the bolts;

FIG. 13 is a perspective view of one embodiment of a manipulator;

FIG. 14 is a top view of the manipulator of FIG. 12;

FIG. 15*a* is a perspective view of one embodiment of a drilling element carousel forming one aspect of the invention;

FIG. 15*b* is an enlarged, partially cutaway view of one drilling element holder;

FIG. 15*c* is a partially cross-sectional view taken along line 15*c*-15*c* of FIG. 16*d;*

FIG. 16*a* is a top view of one embodiment of a drilling element carousel;

FIG. 16*b* is a partially cross-sectional view taken along line 16*b*-16*b* of FIG. 16*c;*

FIGS. 16*c* and 16*d* are different side views of the carousel of FIG. 16*a;*

Figure 17A:
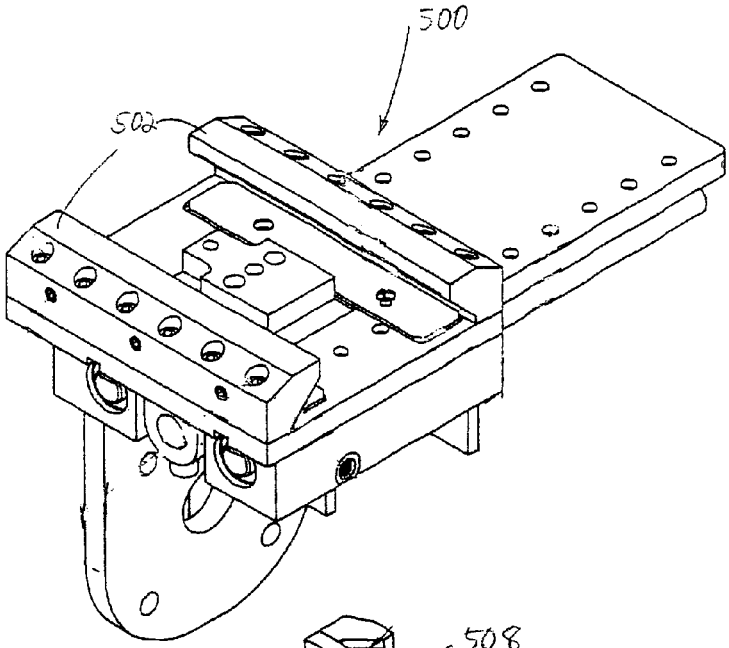
Figure 17B:
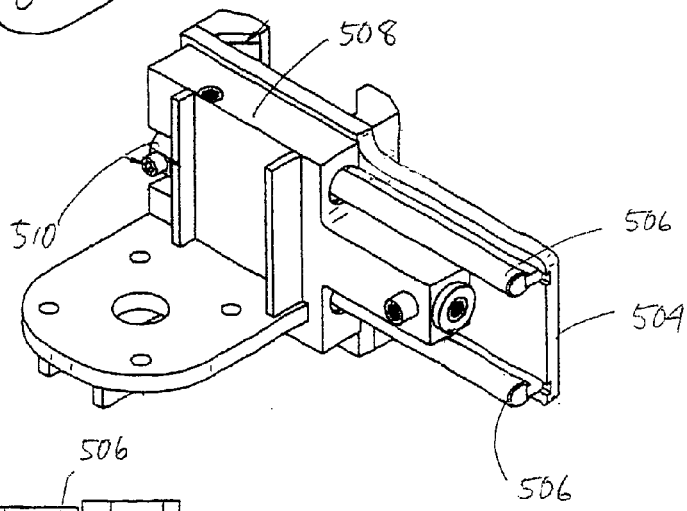

FIG. 17*a* is a rear perspective view of one embodiment of a drill head carriage;

FIG. 17*b* is a front perspective view of the drill head carriage of FIG. 17*a;*

Figure 17C:
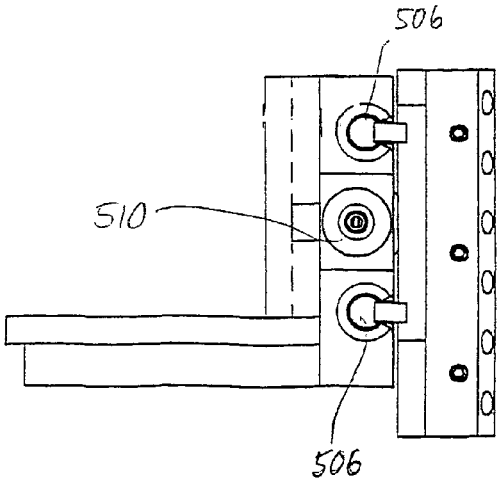

FIG. 17*c* is an end view of the drill head carriage of FIG. 17*a;*

Figure 18A:
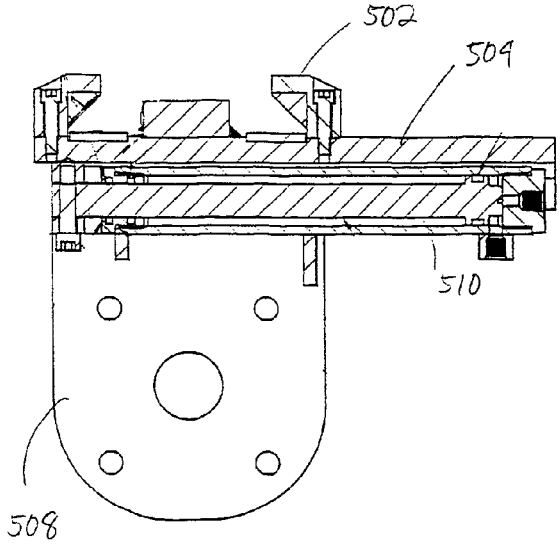
Figure 18B:
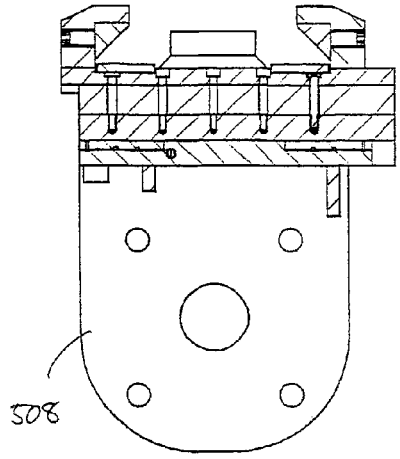
Figure 18C:
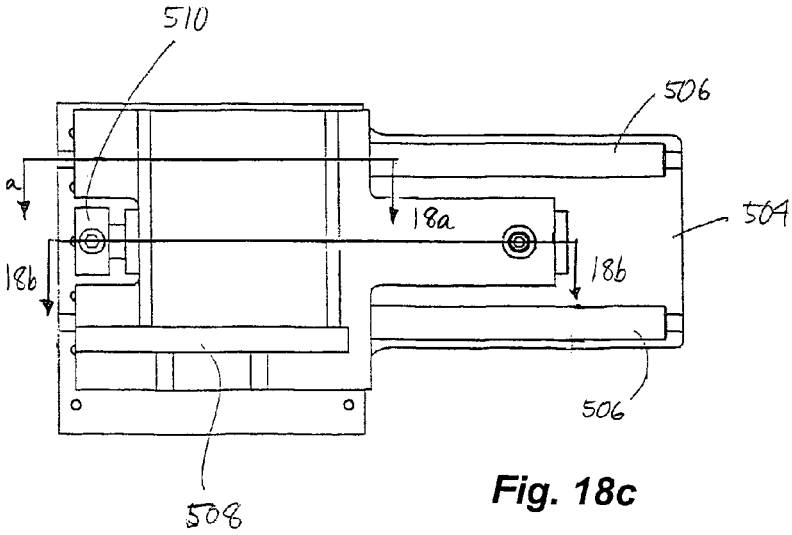

FIG. 18*a* is a partially cross-sectional view of the drill head carriage of FIG. 17*a* taken along line 18*a*-18*a* of FIG. 18*c;*

FIG. 18*b* is a partially cross-sectional view of the drill head carriage of FIG. 17*a* taken along line 18*b*-18*b* of FIG. 18*c;*

FIG. 18*c* is a front elevational view of the drill head carriage of FIG. 17*a;*

Figure 19:
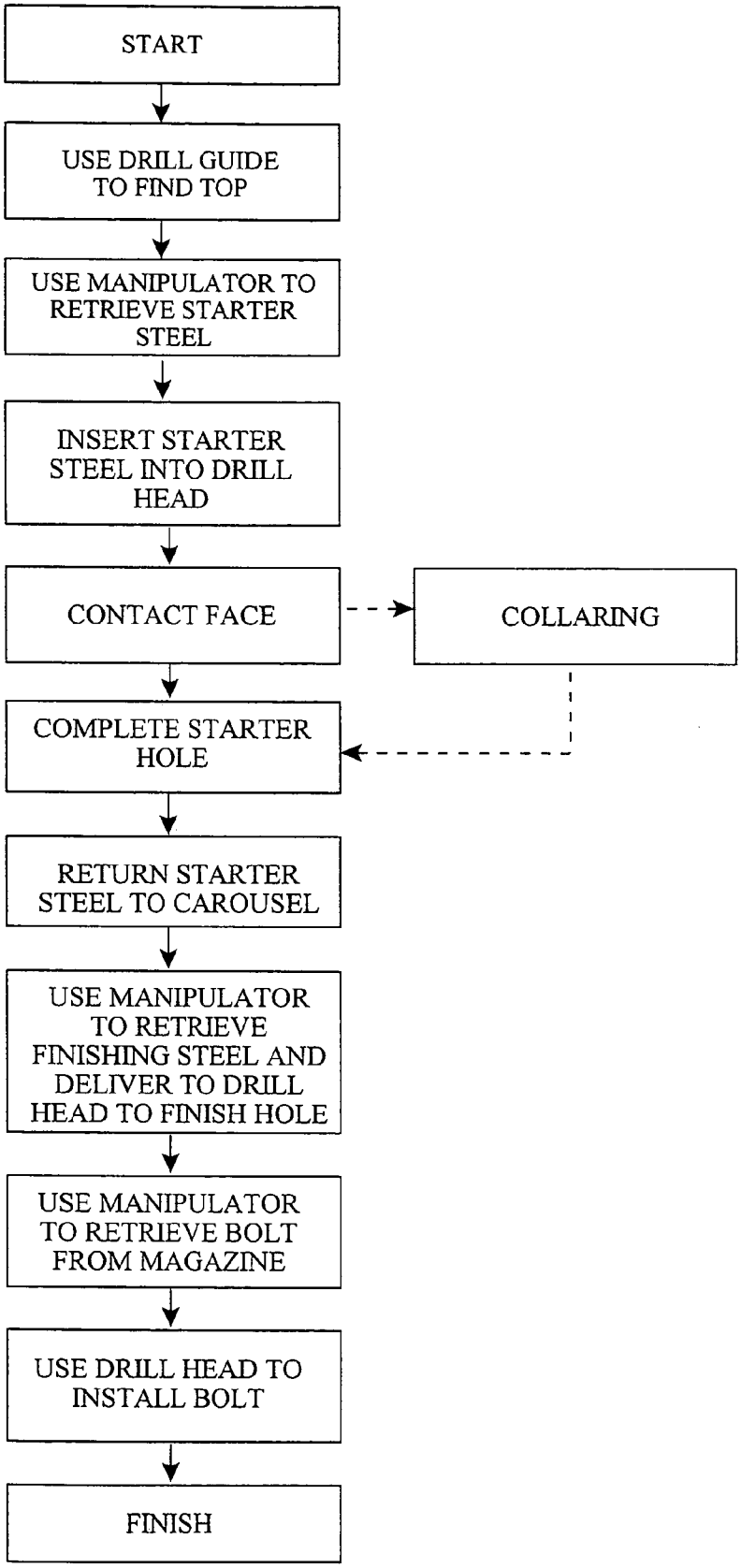
Figure 20:
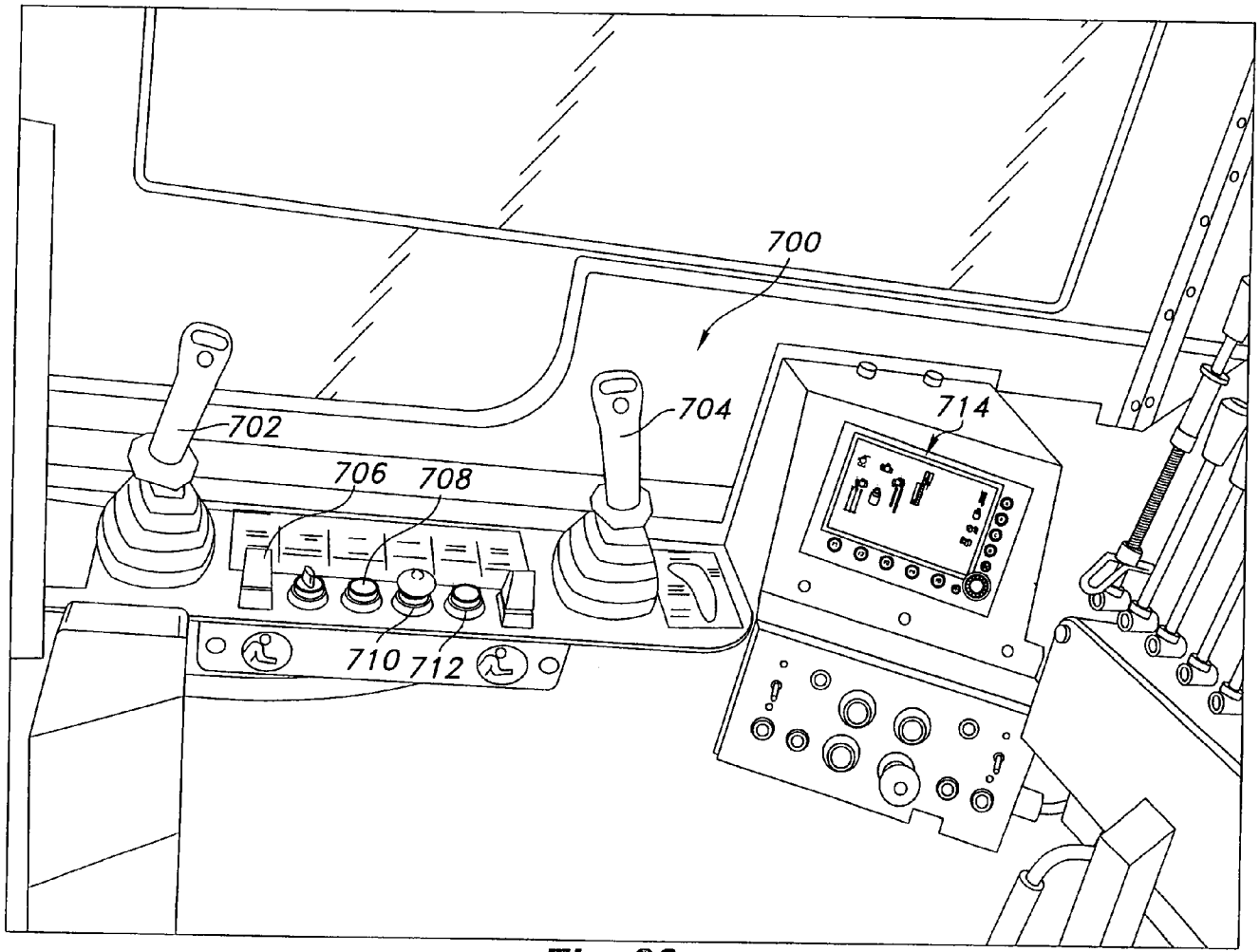
Figure 21:
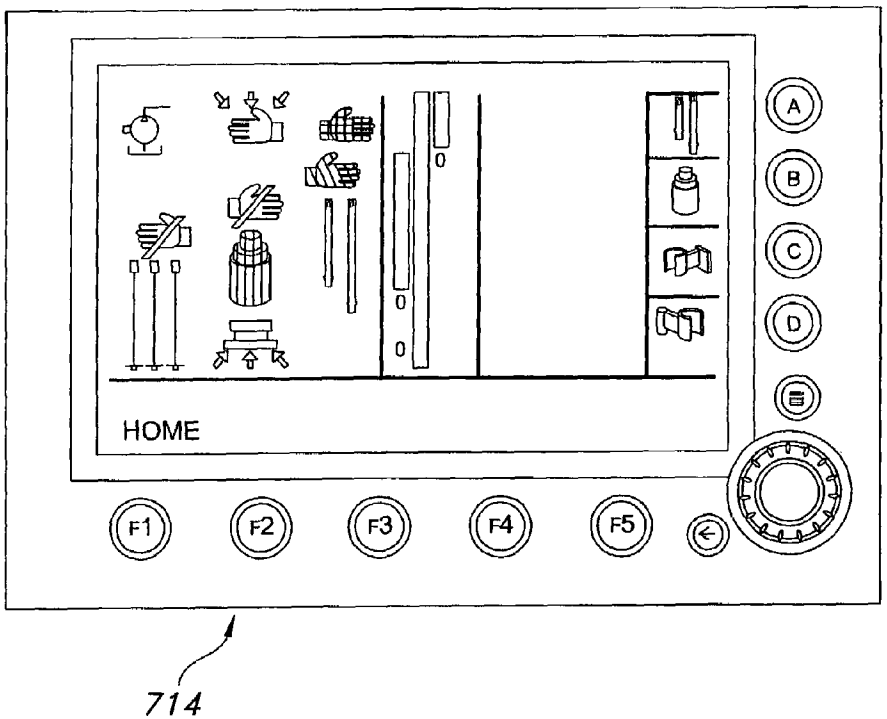
Figure 21:
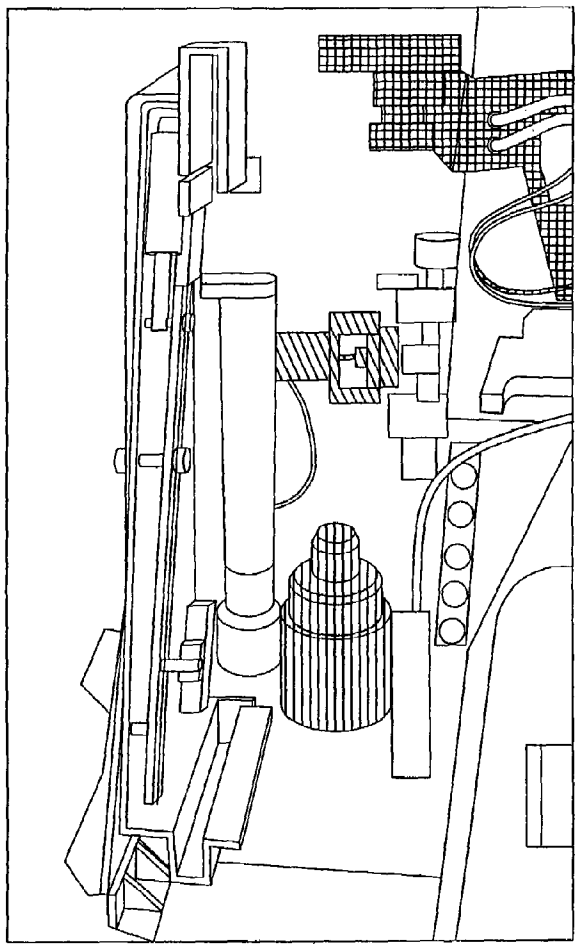
Figure 22:
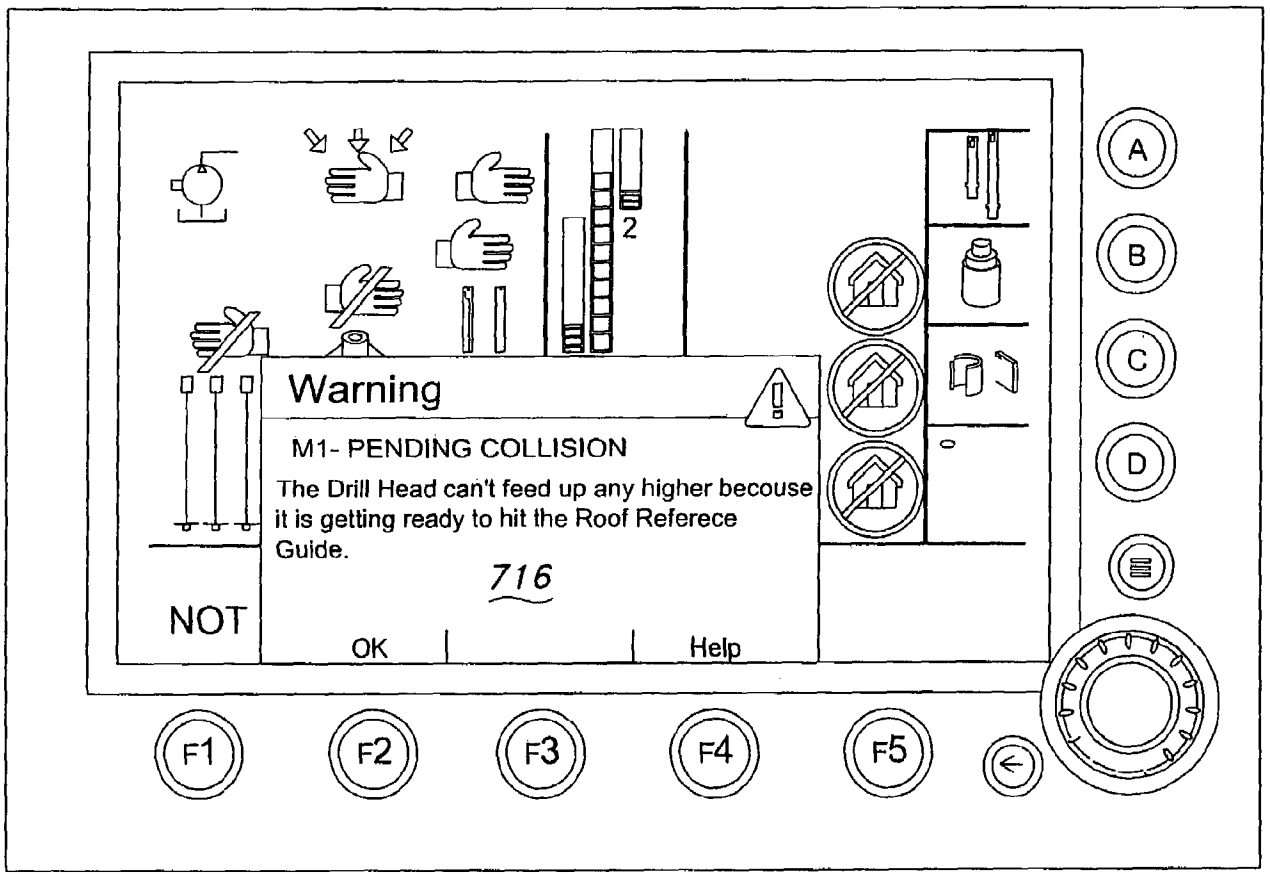
Figure 23C:
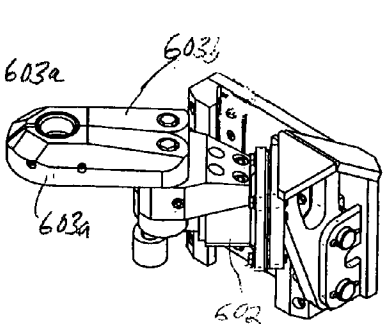
Figure 23B:
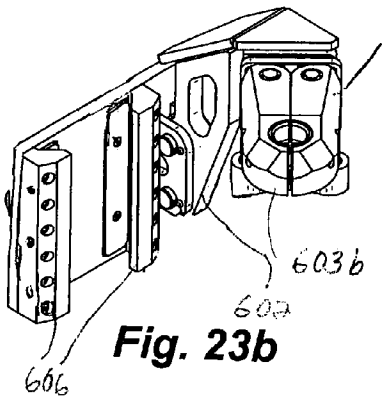
Figure 23A:
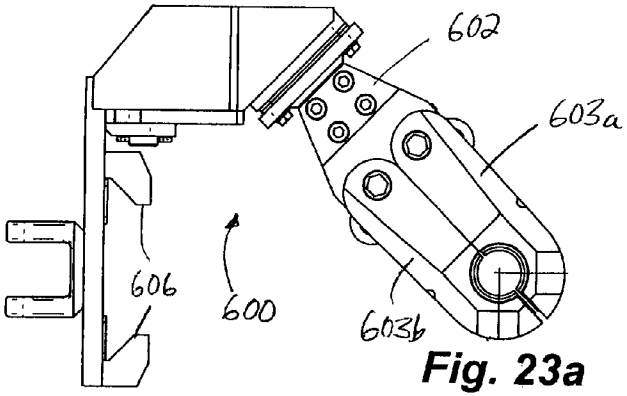
Figure 23E:
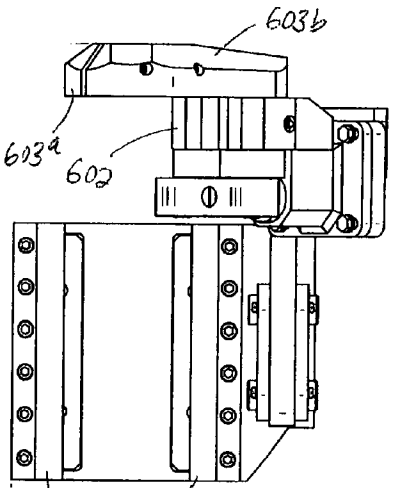
Figure 23D:
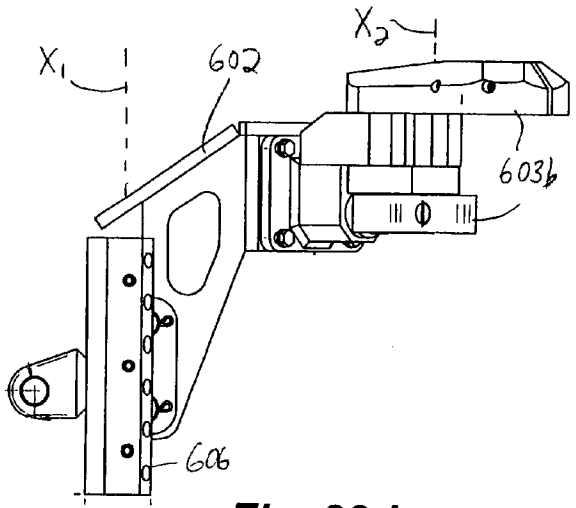

FIG. 19 is a flow chart describing one possible implementation of the automated control forming one aspect of the invention;

FIG. 20 is a perspective view of one embodiment of a remote control panel during automated or manual operation of a drilling and bolting module;

FIG. 21 includes comparative views of the components of the drilling and bolting components and the matching representations on an associated display;

FIG. 22 is a view of the display including a warning message; and

FIGS. 23*a*-23*e* illustrate an alternate embodiment of the drilling reference guide.

DETAILED DESCRIPTION OF THE INVENTION

Figure 2:
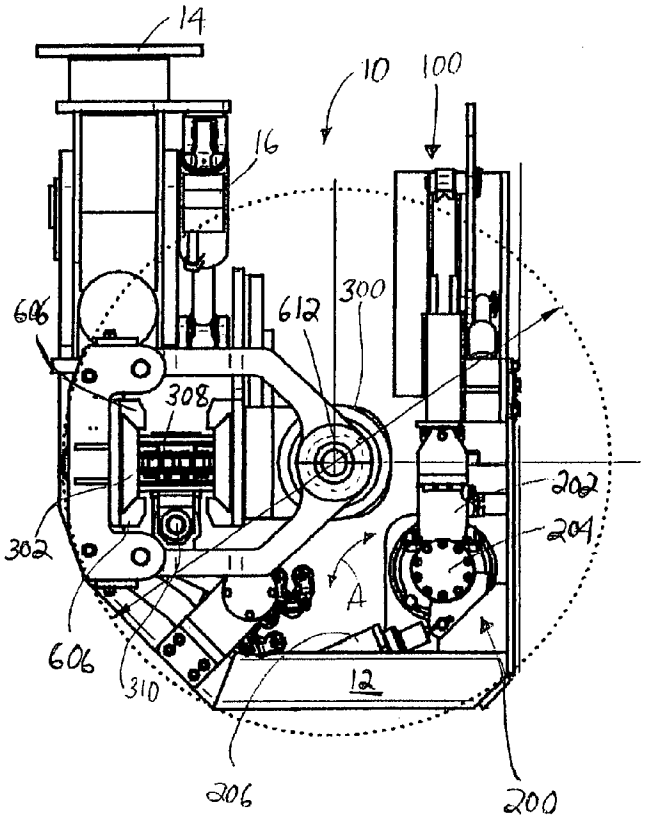
FIG. 2 is a top view of the module of FIG. 1.

Reference is now made to FIGS. 1-5*a,* which taken together illustrate one embodiment of a drilling and bolting module 10 constructed in accordance with the present invention and particularly adapted for use for operating efficiently and effectively in the confines of a narrow mine passage. As should be appreciated, the module 10 includes a frame 12, which typically connects to a tilting boom (not shown) associated with rig, tram, or like vehicle (not shown), such as through a connector 14. Preferably, the arrangement is such that the module 10 may be oriented for drilling into the mine roof (note fore and aft actuator in the form of a hydraulic cylinder 16, as shown in FIG. 2) or the rib (such as by using a hydraulic motor (not shown) to tilt, or "roll" the entire module) in the desired fashion.

The module 10 as illustrated includes several distinct and modular components supported by the frame 12 independent from each other, but in close proximity and arranged to work together in a most efficient and effective manner, especially in a thin seam environment. In the illustrated embodiment, these components include: (1) a bolt holder 100; (2) a manipulator 200; (3) a drill head 300; (4) a drill steel carousel 400; (5) a drill head carriage 500; and (6) a drill (or bolt) guide 600. The function and possible interrelation of these components will now be described in detail.

Figure 6:
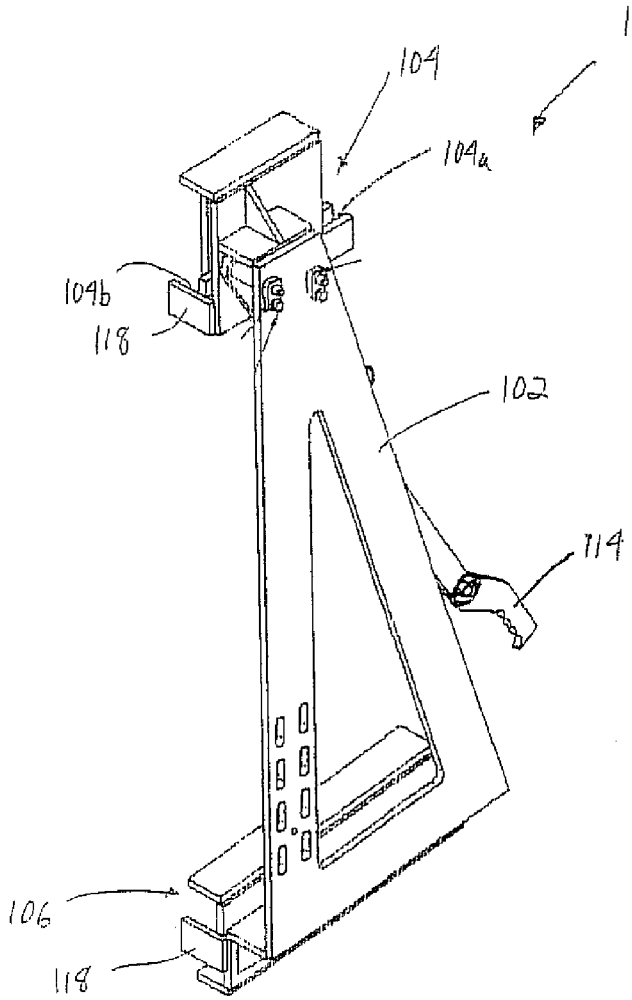

Details of the bolt holder or magazine 100 are perhaps best understood with reference to FIGS. 6-9. Turning specifically to FIG. 6, the magazine 100 includes a frame 102 supporting guides for the bolts. In the preferred embodiment, these guides take the form of upper and lower channels 104, 106 for receiving the respective ends of a plurality of roof bolts B (see FIG. 10) arranged in a linear row, or "indexed." The channels 104, 106 include an open load or infeed end 104*a*, 106*a* and a partially closed unload or outfeed end 104*b*, 106*b* through which the bolts are serially arranged and individually dispensed.

In accordance with one aspect of the disclosed invention, it can be seen that the upper portion of the magazine frame 102 adjacent the upper channel 104 has a longitudinal dimension $L_1$ substantially less than the longitudinal dimension $L_2$ of the portion adjacent the lower channel 106. Aside from giving the frame 102 a generally trapezoidal, but almost triangular profile, this causes the tandem bolts B received in the channels 104, 106 to be canted or skewed slightly in the indexed position (with the exception of the leading bolt, which is generally upright due to the engagement with the terminal end of the channels 104, 106).

Consequently, unlike prior art arrangements (which tend to have the same or a similar longitudinal dimension along both the upper and lower ends of the magazine and thus hold the bolts parallel in a generally vertical orientation), this feature advantageously reduces the dimension of the magazine 100 adjacent the mine roof or "top," where space can be quite tight. Yet, the different dimensions of the associated channels 104, 106 serving as the guides in the particularly preferred embodiment illustrated do not in any way impact performance of the magazine 100, since the next-in-line bolt remains in the desirable generally upright position, ready for installation.

Figure 7:
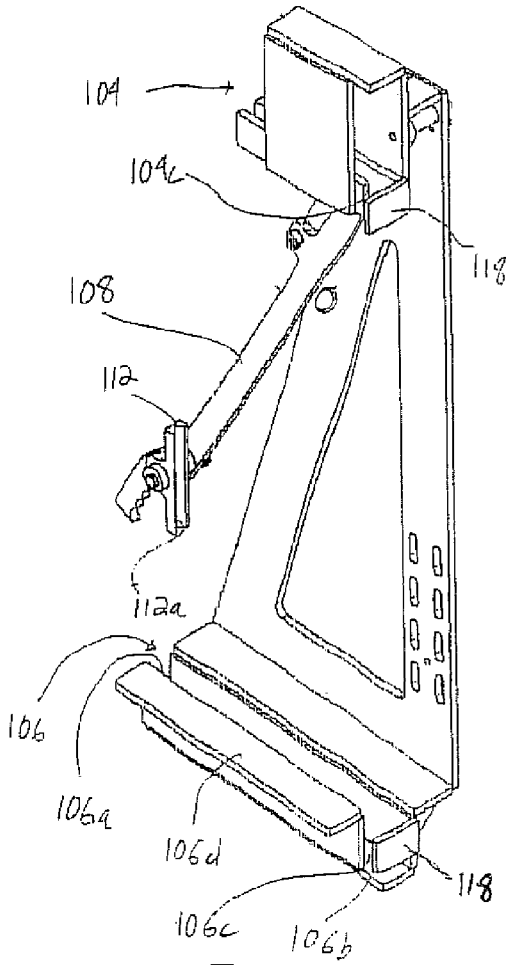
Figure 8:
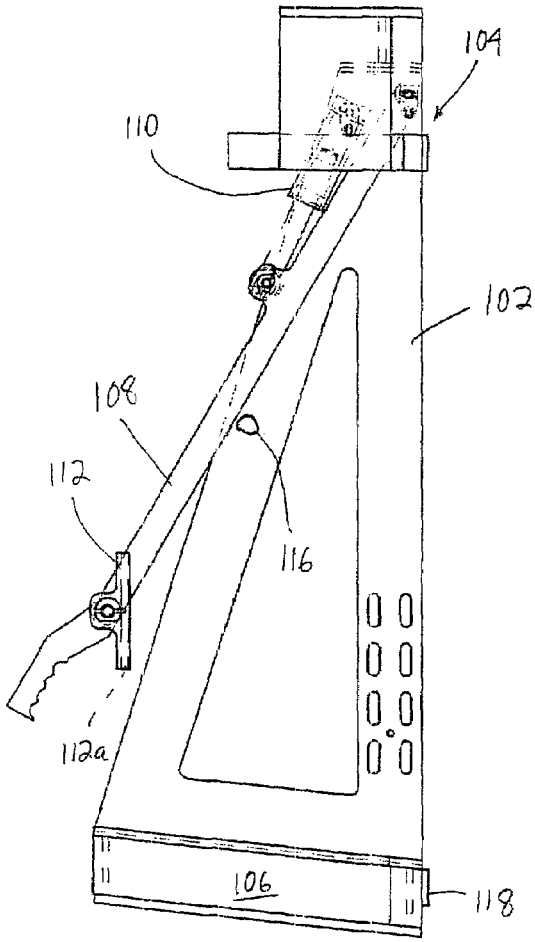
Figure 9:
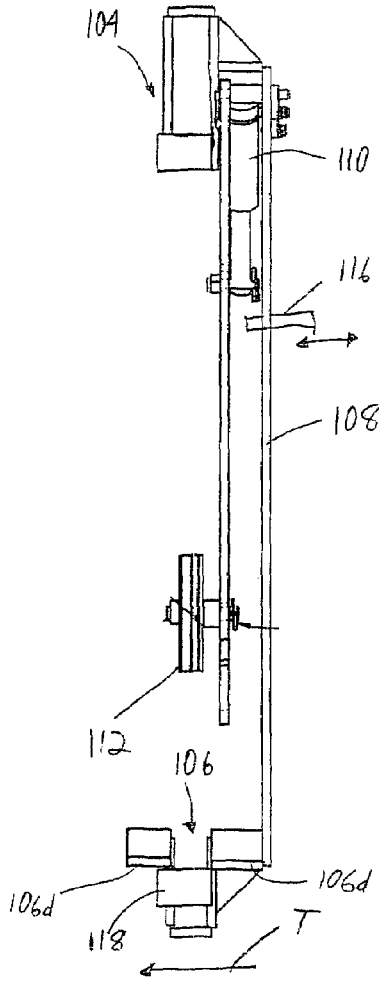
Figure 10:
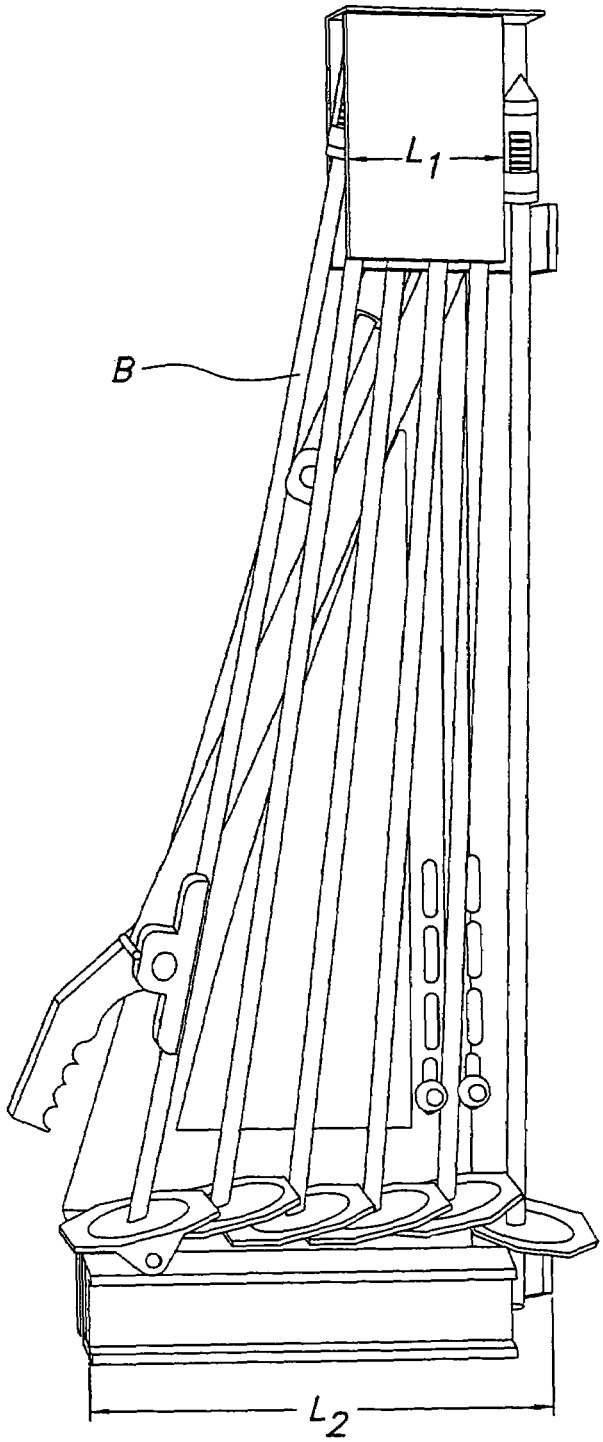

Referring still to FIG. 6, but also with reference to FIGS. 7-9, a swing arm 108 adjacent the "load" end of the magazine 100 pivotally mounts to the frame 102 and is biased in the longitudinal direction towards the delivery end, such as by a spring cylinder 110 or like biasing means (e.g., an extension spring). The arm 108 (which is mounted at an angle of approximately 60° to the horizontal when positioned as shown in the drawing figures) includes a pivotally-mounted retainer 112 (which may optionally include a groove 112*a*) for engaging the last-in-line roof bolt in the indexed row. A grip or handle 114 allows the user to retract the swing arm 108 for purposes of loading the roof bolts through the infeed ends 104*a*, 106*a* of the channels 104, 106.

Figure 11:
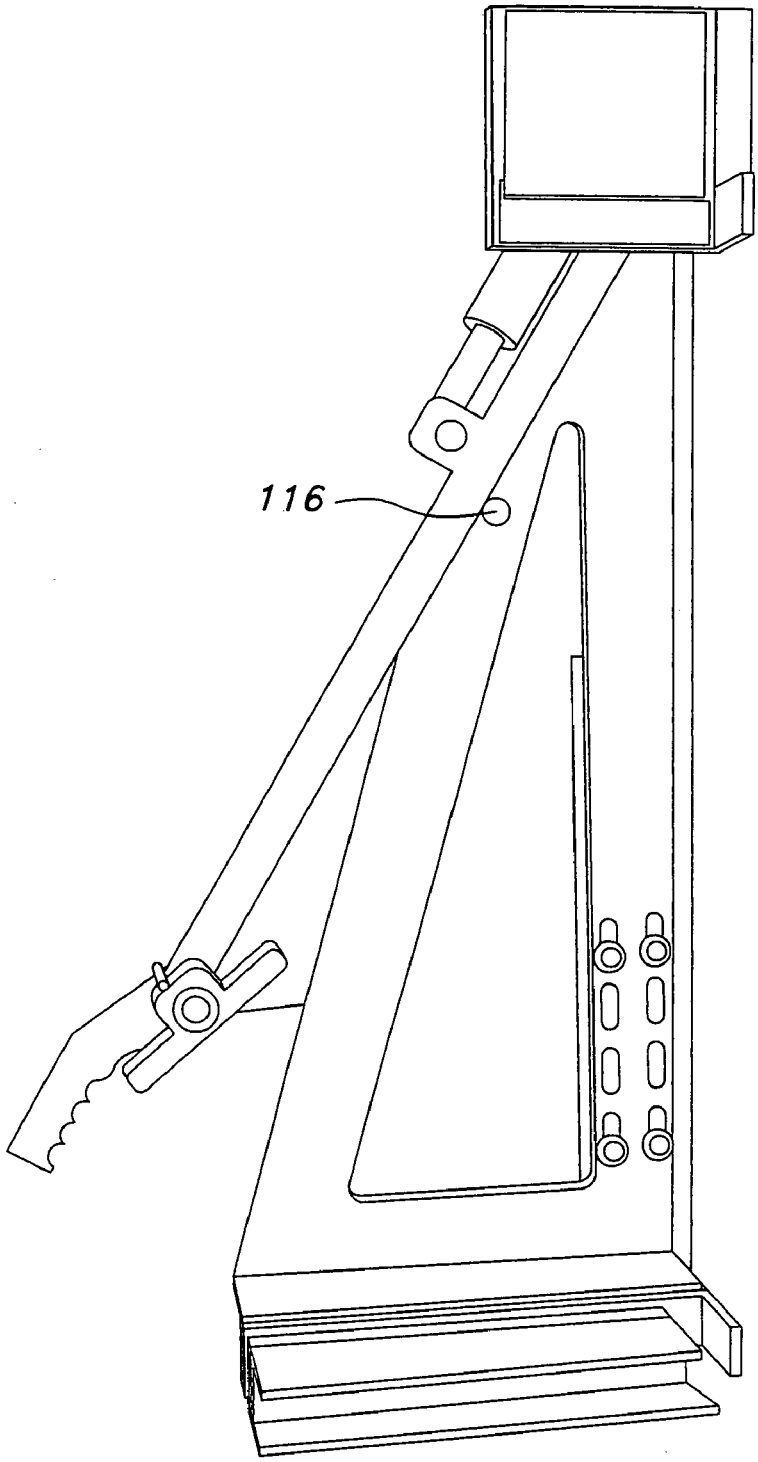

A loading "lock" may be provided for holding the arm 108 in the retracted position, such as during loading. In the preferred embodiment, this lock takes the form of a bolt or pin 116 passing through the frame 102. When moved into the path of the arm 108, the pin 116 is thus capable of engaging and holding it in the retracted position to facilitate loading (FIGS. 11, 12).

The opposite, "discharge" or delivery end 104*b*, 106*b* of each channel 104, 106 includes a keeper 118 for holding the next-in-line bolt in the ready position. In the illustrated arrangement, the keepers 118 extend in a direction generally transverse to the direction of elongation of the channels 104, 106, and thus define a stop along the longitudinal delivery path. Accordingly, the "ready" or next-in-line bolt is removed from the magazine 100 in a direction generally transverse (see direction T in FIG. 9) to the longitudinal direction through an opening 104*c*, 106*c* in each channel 104, 106 adjacent the keepers 118 (see FIG. 7). Further, the lower channel 106 may optionally include opposing flanges 106*d* for supporting a plate or like accessory typically associated with each bolt for engaging the face of the mine passage and providing a bearing surface for the bolt head.

In use, a transporter, such as the manipulator 200 forming one aspect of the invention (see below), removes the next-in-line bolt in the transverse direction and eventually loads it in the chuck of an adjacent drill head 300 (which as discussed further below may be movable both vertically and in a horizontal plane) for installation in the corresponding borehole (which may involve inserting the bolt partially into the borehole before the association with the drill head). As that next-in-line roof bolt is removed, the biasing force supplied by the spring cylinder 110 causes the arm 108 via retainer 112 to advance all loaded roof bolts along the delivery path toward the discharge end of the channels 104, 106, with the next-in-line bolt engaging the keepers 118 (and being righted as a result). The arm 108 via retainer 112 continues to engage the last-in-line bolt while traveling through an arcuate path as each preceding bolt is removed. The pull force of the handle 114 in the preferred embodiment is about 70 pounds, and the force exerted on the last-in-line bolt when the magazine 100 is full is about 40 pounds and reduces to about 12 pounds for a single bolt.

Besides its more compact nature and lower profile, advantages of this preferred arrangement of the magazine 100 include the lack of active hydraulics (or power, for that matter) and the associated controls for advancing the bolts, both of which are requirements of known prior art approaches. Facilitating bolt loading is the absence of any predetermined index positions for the bolts, which thus allows for serial loading from the infeed end. The lack of active moving parts may also allow for bolt loading to occur while other components of the module 10 are operating (depending, of course, on whether it is safe to do so or not in the particular circumstances). Even if not, the ease with which a set of bolts can be loaded and its passive operation make use of the magazine 100 highly advantageous in terms of efficiency and maintenance.

As noted above, the module 10 further includes a manipulator 200, including an elongated manipulator arm 202 designed to engage the bolts (or the drill steels, as discussed further below) and deliver or transport them to the chuck of the drill head 300 for insertion in the borehole. In the illustrated embodiment, the manipulator arm 202 is mounted to a rotatable post 204 actuated by an actuator, such as a hydraulic cylinder 206 carried by the frame 12. Actuation of the cylinder 206 thus pivots the arm 202 to-and-fro between the outfeed or delivery end of the magazine 100 and the drill head 300 along a generally arcuate path (note arrow A in FIG. 2).

In the past, many bolting modules employed opposed rubber bushings or magnets to hold the bolts in place during conveyance to the drill head from a storage location, such as a magazine in the form of a carousel. However, both of these types of arrangements can be unreliable in use, especially in the hostile environment of an underground mine. Thus, in accordance with another aspect of the invention, the arm 202 carries a gripper 208 capable of assuming a first position for gripping a bolt and a second position for releasing or guiding it, such as at drill head 300.

With reference now to FIGS. 13 and 14, the gripper 208 most preferably comprises a pair of hydraulically actuated, opposed, and generally symmetrical jaws 210*a*, 210*b*. Upon actuation, these jaws 210*a*, 210*b* simultaneously pivot toward each other to a closed position and can thus securely grip the bolt (or drill steel; see below). To facilitate gripping, each jaw 210*a*, 210*b* includes a semi-circular groove. Together, these grooves create a channel sized to receive and securely hold the bolt when gripped.

To ensure that a proper gripping force is applied, the jaws 210*a*, 219*b* may be operated using means that compensates for wear. Specifically, the opening and closing of the jaws 210*a*, 210*b* may be accomplished based on monitoring of the pressure difference of an associated hydraulic device, such as a cylinder, using a sensor, such as a pressure transducer. Thus, the hydraulic force for closing the jaws 210*a*, 210*b* may be applied until the pressure difference (e.g., a "spike") is seen, which thus ensures that the proper gripping force is applied, regardless of wear on the corresponding surfaces over time. Likewise, opening of the jaws to the maximum extent to ensure that the low profile face is provided may also be done until a pressure difference is seen by the sensor.

As noted above, it is desirable to make the module 10 as compact as possible, especially when used in low seam conditions. To permit mounting of the manipulator arm 202 as close as possible to the other components while avoiding the need for additional movement in the linear (radial) direction (and thus eliminating the need for a corresponding motive device), the jaws 210*a*, 210*b* are preferably designed and mounted such that both lie in generally the same vertical plane as the front face of the gripper 208 in an open position. As should be appreciated, this allows the gripper 208 to be pivotally moved through the arcuate path in close proximity to the magazine 100 or other holder such that a bolt ready for use lies adjacent to the front face between the jaws 210*a*, 210*b*. At that point, the jaws 21*a*, 210*b* actuate to grip the adjacent bolt, and the cylinder 206 actuates to pivot the arm 202 and move it toward the drill head 300 where the bolt may be released (but may still be guided by the gripper 208 during installation into the borehole).

The post 204 itself may also be adjustable in the drilling and bolting direction (e.g., vertically), such as by associating it with a hydraulic cylinder or like actuator. Consequently, once the bolt releases to engage the chuck of the drill head 300, the jaws 210*a*, 210*b* may remain partially closed. In this way, the jaws 210*a*, 210*b* assist in guiding the bolt as it moves along an associated linear mast 302 into the previously formed borehole. Also, the arm 202 may move toward the face to install the bolt partially in the borehole before the association with the drill head occurs (such as if it has been moved out of the way; see below).

A sensor, such as a linear displacement transducer (not shown), may be used to determine the position of the gripper 208 in a direction parallel to the mast 302 (e.g., typically the vertical direction during roof bolting) in a first plane. Likewise, proximity sensors may also be used to determine the position of the gripper 208 along the generally arcuate path of travel about the post 204 in a second plane, typically perpendicular to the first plane (which path of course includes the outfeed or delivery end of the bolt magazine 100 and the chuck of the drill head 300). Using the output signals from these sensors, the relative position of the gripper 208 is known at all times.

The foregoing discussion regarding the installation of a bolt presupposes the existence of a completed borehole for receiving it. Besides automating the bolting process, it is of course desirable to automate the drilling process as well. Thus, in accordance with still another aspect of the invention, and with reference to FIGS. 2, 15*a*-15*c*, and 16*a*-16*d*, a drilling element, or "drill steel," holder 400 is also positioned along the arcuate path. Consequently, the manipulator 200 can perform the dual function of conveying the steel for forming the borehole to the drill head 300, similar to the manner in which a bolt is transported from the magazine 100.

In the illustrated embodiment, the drill steel holder 400 is in the form of a carousel 402 capable of holding at least two different drill steels D1, D2 (see FIGS. 15*a* and 16*a*) having bits, such as a short starter steel for forming a starter borehole and a longer finishing steel for completing the job (which arrangement is particularly desirable in low seam conditions where the maximum length of the drill steel is obviously limited). In particular, the carousel 402 includes a rotatably mounted shaft 404 (FIGS. 15*c* and 16*b*) carrying first and second pairs of aligned holders, such as flexible rollers 406*a*, 406*b*; 408*a*, 408*b* for gripping and holding the corresponding drill steel D1 or D2. As shown, the rollers of each pair 406*a*, 406*b*; 408*a*, 408*b* are spaced apart a predetermined distance, and biased by springs 409*a*, 409*b* towards each other to create an opening generally smaller than the diameter of the corresponding drill steel (which may be different, such as in the case where it is desirable to first form a starter borehole having a larger nominal (maximum) diameter (e.g., 1⅛") using the first, starter steel and then finish the hole using the second drill steel with a smaller nominal diameter (e.g., 1")).

In use, an associated actuator, such as a linear cylinder 410, rotates the shaft 402 to move the steel to a common pick up point along the path accessible by the gripper 208 of the manipulator arm 202 in a manner similar to the bolts. The manipulator arm 202 then pulls the selected drill steel through the rollers 406*a*, 406*b*; 408*a*, 408*b* by overcoming the biasing force and delivers it to the drill head 300 (or inserts it partially into the borehole first, as discussed in more detail below). The jaws 210*a*, 210*b* then move away from each other to release the steel to the drill head 300. Besides overcoming the height limitations, the use of two separate drill steels advantageously may avoid the need for coupling multiple steels together in order to form a borehole, such as during an automated or remote drilling operation. Avoiding the requirement of a coupling may allow for a smaller diameter borehole to be formed that would be the case with conventional drill steel segments coupled together with threads (which, when smaller, are more difficult to match when using an automated system). Consequently, the size of the bolt and other consumables used becomes smaller, which further contributes to a space savings, including at the mine top. Recovery of cuttings and dust may also be facilitated by the annulus (gap) between the larger diameter starter borehole and the smaller diameter finishing steel.

Once the particular drilling operation is complete (starting the borehole or finishing it), the manipulator arm 202 returns the corresponding steel to the common point. Before the return operation is complete, the shaft 402 is rotated such that the corresponding drill steel is engaged by the corresponding holders moved into the arcuate path of the manipulator arm 202. Once the steel is moved within the grip of the rollers 406*a,* 406*b;* 408*a,* 408*b,* the gripper 208 releases, and eventually moves adjacent to the outfeed end of the magazine 100 for gripping the next-in-line bolt.

In many cases, it is desirable to fix the module 10 in the mine passage before the drilling or bolting operation commences and thus prevent it from moving to any significant degree. In the preferred embodiment, this is accomplished in part using the rigid linear "slider" mast 302 for supporting the drill head 300, the top of which is designed to engage the adjacent face of the passage (typically the roof) and thus serve as a "stinger." The opposite face of the passage is then engaged by a stab jack, or "floor" cylinder 304 as it is known in the vernacular. Together, the mast 302 and actuated stab jack 304 fulfill the desired function of holding the module 10 in place.

In accordance with another aspect of the invention, the floor cylinder or stab jack 304 operates in two distinct modes: manual and automated. In manual mode, the operator controls or sets the pressure of the jack 304 and internal load holding valves maintain this preset pressure at the desired level. In the automated mode, the jack 304 is set manually and the pressure is continuously monitored, such as by using a sensor (transducer). Thus, if the engaged face of the corresponding mine passage settles during operation, the pressure difference is automatically detected and the jack 304 extended or advanced to maintain the predetermined pressure level.

The drill head 300 mounts to the linear mast 302 by way of a carriage 500. In accordance with still another aspect of the invention, the carriage 500 of the preferred embodiment is arranged such that it allows the drill head 300 to translate laterally in a direction generally transverse to the direction of elongation of the mast 302 (also referred to as the drilling direction or path). With reference to FIGS. 17*a-c* and 18*a-c,* the carriage 500 includes a pair of gibs 502 that slidably interface with the mast 302 along one side. The gibs 502 are in turn connected to a cross member 504 supporting a pair of spaced, generally parallel rails 506 along which a support base 508 for the drill head 300 travels. An associated actuator, which preferably takes the form of an internal hydraulic cylinder 510, slidably moves the base 508 to and fro along the rails 506. Likewise, an associated sensor, such as a proximity switch (not shown) may also be provided to detect the support base 508 in the extended or "end of travel" position. The carriage 500 is associated with an endless chain 308 and slidably moves along the mast 302 through a connection with an associated actuator, such as a hydraulic cylinder 310, in a known fashion (i.e., using a "2:1" travel/stroke ratio).

This arrangement advantageously allows for the drill head 300 to be moved out of the path of the manipulator arm 202, such as when it is carrying the finishing steel or bolt (the lengths of which may exceed the distance between the top of the chuck with the drill head at the lowest position and any drill guide 600 or like structure associated with the distal end of the mast 302 for guiding the drill steel or bolts into the borehole). The manipulator arm 202 including the gripper 208 can thus move the finishing steel into the previously formed starter hole, or alternatively move a bolt into the completed ("finished") hole, through the guide 600. The carriage 500 may then translate the drill head 300 back to a position such that the chuck is aligned with and receives the bolt or steel upon being released by the jaws 210*a,* 210*b.* The size of the drill head 300 thus need not be factored into the maximum length of the bolt or drill steel used, which is of immense benefit in low seam environments where space availability is the limiting design factor.

As can be understood from reviewing the foregoing and FIG. 1, the drill guide 600 associates with the mast 302 and thus translates along it toward the adjacent face of the mine passage. In particular, the drill guide 600 includes a pair of arms 602*a,* 602*b* pivotally mounted to a carriage 604. The carriage 604 is in turn slidably mounted to the mast 302 by associated gibs 606 along the side opposite the drill head carriage 500. A first actuator, such as a hydraulic cylinder 608, causes the arms 600 to move toward each other to provide a guiding function for the steel or bolt, and also away from each other in a transverse direction, such as for allowing a resin inserter/cartridge and bolt "assembly" (such as one including a plate) to pass without interference. A second actuator, which may also comprise a hydraulic cylinder 610 or other means for advancing the drill guide 600, slidably moves the carriage 604 to and fro along the mast 302.

Figure 4:
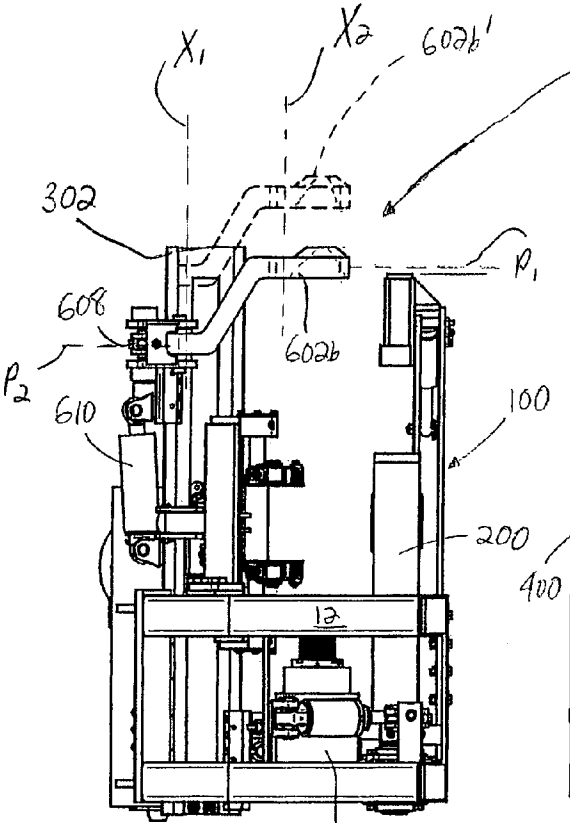
Figure 3:
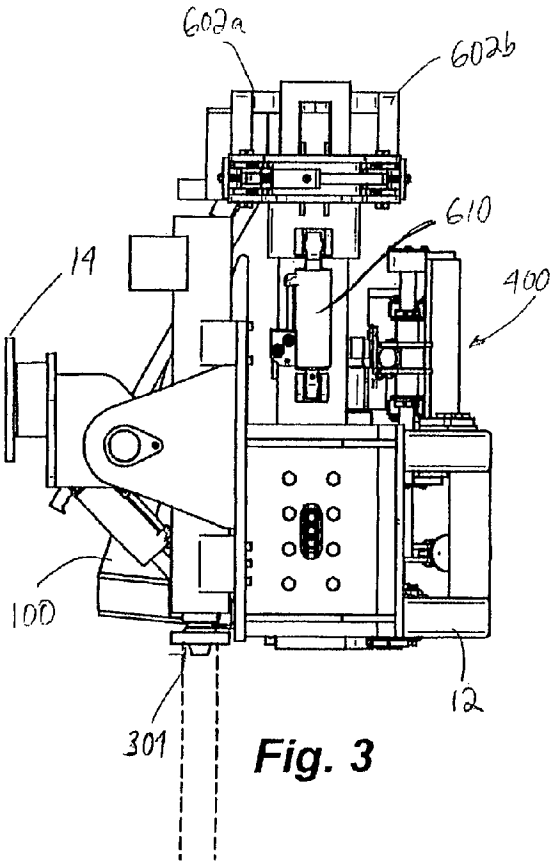

In accordance with a further aspect of the invention, and with specific reference to FIG. 4, at least one, and preferably both of the arms 602*a,* 602*b* forming the guide 600 have a low profile and, most preferably, a gooseneck profile (stated another way, the part of each arm 602*a,* 602*b* associated with the carriage 604 lies in a first plane spaced apart in the direction of elongation of the mast 302 from the guide end of each arm, and an intermediate part connects the two). Stated another way, and with reference to FIG. 4, the arm 602*a* or 602*b* with the gooseneck profile includes a first part extending in a first plane P1 and intersecting a first axis X1, a second offset part extending in a second plane P2 generally parallel to the first plane P1 and intersecting a second axis X2 spaced from and generally parallel to the first axis A1, and a third part connecting the first and second parts.

Thus, when the top of the mast 302, or "stinger," is in engagement with the corresponding face of the mine passage, this profile in combination with the actuation of the second hydraulic cylinder 610 allows the guide 600 to reach up into contact with the face, even if there is a cavity or recess ("pot") in it. This helps to ensure that the borehole is formed in the proper manner by guiding the drill steel as close to the face as possible, and also serves reliably to guide the bolt into the hole once formed.

In accordance with yet another aspect of the invention, before drilling and typically after the mast 302 and stab jack 304 are in engagement, the guide 600 is also moved into contact with the face of the mine passage to "find" the location to be drilled (e.g., the "top" of the mine passage, which is usually synonymous with the roof). Upon such contact being made, a sensor (such as a pressure transducer) associated with the second cylinder 610 detects a pressure difference, or "spike," thus caused by the increased resistance to movement and generates a signal to stop the advance. An associated sensor, such as a linear displacement transducer (not shown), relates the contact position relative to the top of the mast 302 based on the known displacement of the drill guide 600, thus informing the operator and/or the associated controller of the position of the adjacent face or roof and allowing for full automated operation on this basis (see below). Together, these components thus serve as a means for detecting the relative location of the face using the drill guide.

In the contact position, the opening 612 defined by the distal ends of the arms 600 when adjacent each other thus helps to guide the steel(s) during forming of the hole, and also initially guides any resin inserter and associated bolt into the borehole one formed. To facilitate the combined guiding and engaging functions, the underside of the arms 602*a,* 602*b* adjacent the opening 612 formed when they are brought together may be frusto-conical or tapered to thus form a "funnel" that helps to guide the steel or bolt through the opening 612. Likewise, the opposite surface of one or both of the arms 602*a*, 602*b* may project outwardly to provide an engagement surface 614 for contacting the face during operation (see FIG. 5).

Figure 5A:
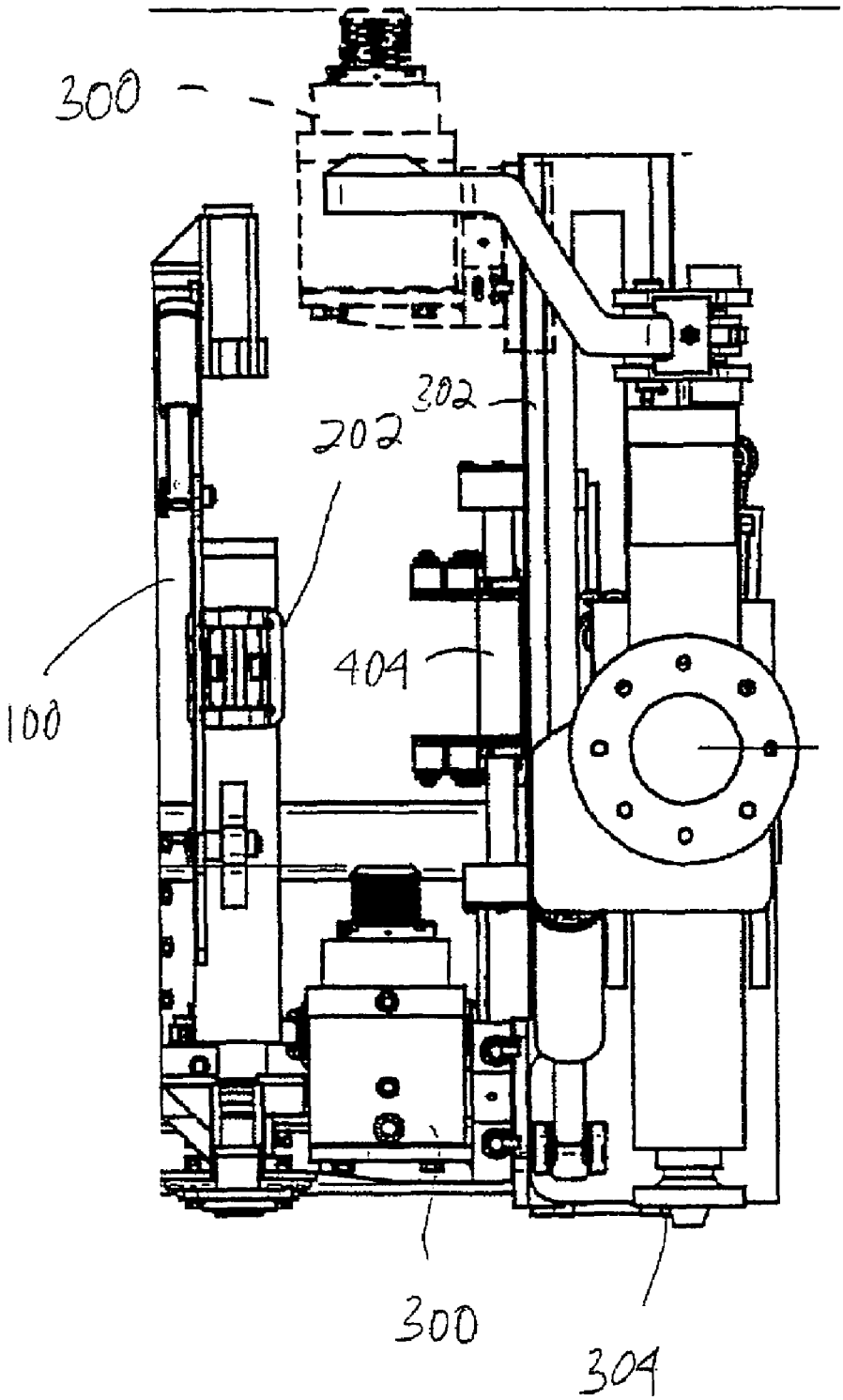

As noted above, the bolt typically comprises an assembly including a plate or like structure at the distal end (see FIG. 10), and the arms 602*a*, 602*b* must separate a sufficient distance to allow it to pass (and also to allow the drill head 300 to pass, if necessary; see FIG. 5*a*). Preferably, the guide 600 is lowered before separation is effected by actuating the first cylinder 606, since this will help to avoid engaging adjacent surfaces of the face. In such instance, the linear displacement transducer relates the position of the guide 600 to avoid collisions with the drill head 300 moving along the mast 302 (which is in this instance functioning as a bolt inserter). The arms 602*a*, 602*b* may also open to allow the drill steel to pass into the chuck of the drill head, if necessary.

Although the arms 602*a*, 602*b* are shown as being symmetrical and capable of closing, neither is a requirement. Specifically, only one of the arms 602*a* or 602*b* may include a structure for contacting the face of the mine passage. Likewise, it is not necessary for the arms 602*a*, 602*b* to contact each other when closed, since the guiding function can still be reliably provided.

As can be appreciated by a skilled artisan, a controller is provided to control the operation of the various components of the module 10, such as in an electro-hydraulic fashion. Preferably, the control of the module 10 is remote and automated, such that the operator may be positioned away from the drilling and bolting location to ensure safety. A typical control sequence presumes that the components 100-600 are all used together, which of course is not necessary.

Preferably, the control used batches several functions into a single operator input. On some remote machines, the operator has a multitude of control buttons and handles, and it becomes a time-consuming and potentially overwhelming task to control the drilling process. By batching machine commands into corresponding inputs or, in the case of this machine, one input to complete the drilling and bolting cycle, a consistent ergonomic control is provided. FIG. 19 shows an example of the automatic flow of the control upon actuation of the single operator input.

More specifically describing one possible embodiment of the automated control with reference to FIG. 19, the operator actuates the automated sequence using an input device (such as using a single start button; see FIG. 20), which may be associated with a computer for running the algorithm necessary to cause the module 10 to operate in the desired manner. This computer-implemented control algorithm may first cause the drill guide 600 to advance and locate the adjacent surface to be worked, and looks for the signal indicative of the pressure difference caused thereby. The manipulator 200 is then used to access the starter steel D1 and insert it into the drill head 300. The drill head 300 advances the starter steel D1 into contact with the face (the location of which is known because of the drill guide 600 preceding it). The drill head 300 then completes the starter hole and returns to a home position, at which the manipulator 200 removes the starter steel, returns it to the carousel 400, and acquires the finishing steel D2. Once the finishing steel D2 is placed in the drill head 300 (which may involve partially inserting the finishing steel into the starter hole and then moving the drill head into position for advance), the hole is then completed.

Once the drill head 300 returns to the home position, the manipulator 200 is used to return the finishing steel D2 to the carousel 400. The manipulator 200 then accesses the next-in-line roof bolt from the magazine 100 and positions it for delivery to the drill head 300. The drill head 300 is then used to advance the roof bolt into the borehole. In the case where a suitable resin has been pre-installed in cartridge form, the bolt ruptures the cartridge and is then rotated by the drill head 300 to mix and cure the resin. In the case where the bolt includes an expansion shell, rotation is also usually necessary to properly seat the shell in the borehole and anchor the bolt in place.

With continued reference to FIG. 19, the control aspect of the invention may further include a collaring subroutine and means for initiating it if a lack of solid contact between the drilling element and face is indicated. Specifically, upon contacting the starter steel with the face (e.g., the roof) of the mine passage, means for detecting the contact between the drilling element and the face, such as a sensor, transducer, or other like device associated with the corresponding cylinder, may monitor and look for a pressure difference (e.g., a spike) caused by the resistance to forward movement created. If the level of the pressure difference output by the sensor is not as anticipated (e.g., it does not match one created by the drill guide 600) upon reaching the same relative position, then this is an indication that the bit or tip of the drilling element may not be in solid contact with the face (such as if the drilling module 10 is at an acute angle relative to the plane of the face) and subject to undesirable walking. This can lead to poor results, since the hole location might not be as expected for purposes of installing the roof bolt.

In such case, a collaring step may be implemented as part of the control. During such step, the starter steel is initially advanced with a lower force to aid in starting the borehole at the desired location and without causing (or at least minimizing) the undesirable walking. The rotational speed may also be increased to assist in forming the hole under the lower feed condition. The drill head may also be advanced and retracted several times during collaring at the lower force. Once a predetermined time lapses or the steel advances a certain distance (an indication that the initial portion of the borehole has been formed), then the collaring subroutine may end and normal, but automated drilling commence to complete the borehole.

As perhaps best shown in FIG. 20, normal as well as automatic operation may be accomplished through a control panel 700 with two miniature joysticks 702, 704 for feed and rotation and other control selectors, such as: (1) a selector switch 706 for the stab jack 304 active or manual selection; (2) a "home" pushbutton 708 to send the mechanical arms, drill head, etc. to the home or safe position; (3) a "stop" pushbutton 710 to abort the cycle, in effect stopping the machine in the current state of operation; and (4) a start auto pushbutton 712 forming part of the means that starts the machine to begin the automated program sequence.

In any condition that requires manual intervention, an associated display 714 with a graphical user interface may become an important part of the control. As perhaps best shown in FIG. 21, the display may provide color coded icons to represent the various machine components as a graphical user interface. For example, the display 714 may have a depiction of a colored (e.g., red) drill head on the screen that corresponds to the actual drill head, which includes a matching color (such as by being painted red). By manipulating the function buttons (e.g., F2), the drill head will be manipulated. The same scheme holds true for the roof reference guide, which may be a different color (e.g., yellow) to match the corresponding icon (a hand, in FIG. 21), as well as the roof bolt magazine (e.g., purple and similarly colored representations of roof bolts) and the manipulator arm (e.g., green and a hand to denote the gripping action). The particular colors selected are unimportant, but should be sufficiently different and bright enough to facilitate easy visual perception and recognition by the operator (especially in a dark underground passage).

The control may also use signals obtained from the various movable components (e.g., manipulator 200, drill head 300, and drill guide 600) regarding their proximity to each other and use display 714 to visualize movement of the components during the drilling or bolting. The control may use the outputs of the proximity sensors to generate an error signal in the event the operator attempts to operate the components such that interference (e.g., a collision) could result. In the embodiment shown in FIG. 22, this signal is used to generate a warning, such as a graphical message 716, on the display 714 with the graphical user interface. The operator may then take appropriate corrective action.

Finally, FIGS. 23*a*-23*e* illustrate an alternate embodiment of the drilling reference guide 600 with gibs 606 for engaging the mast 302 along a guide surface opposite the drill head (not shown). In this embodiment, a single support arm 602 has the gooseneck profile (see FIG. 23*d* and note spaced axes X1 and X2), and supports pivoting, separable guide arms 603*a*, 603*b* that together form the drill passage when closed. Also, instead of extending on either side of the drill head (not shown) as with the embodiment of FIGS. 1-5, these arms 602, 603*a*, 603*b* generally extend from one side only, which helps to save space adjacent the face.

The foregoing descriptions of various embodiments of the invention are provided for purposes of illustration, and are not intended to be exhaustive or limiting. Modifications or variations are also possible in light of the above teachings. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention.

The invention claimed is:

1. A drilling element carousel for associating with a drill head, comprising:

a rotatable body carrying a first holder for holding a first drilling element having a first bit and a second holder for holding a second drilling element having a second bit wherein the body rotates to present either the first drilling element or the second drilling element for insertion in the drill head for forming a borehole, wherein the first drilling element has a length different from the second drilling element.

2. The carousel according to claim 1, wherein each holder comprises first and second pairs of rollers spaced apart in a direction of elongation of the associated drilling element.

3. The carousel according to claim 2, wherein the rollers are made of a flexible material and biased toward each other to define a passage having a dimension less than a diameter of the associated drilling element.

4. The carousel according to claim 1, wherein the first and second drilling elements have different nominal diameters.

5. A method of forming a finished borehole in a face using the carousel of claim 1, comprising:

using the first drilling element to form a starter borehole;

withdrawing the first drilling element from the starter borehole;

inserting the second drilling element at least partially into the starter borehole; and advancing the second drilling element into the starter borehole and form the finished borehole.

6. A method of forming a finished borehole in a face using a drill head for advancing along an elongated mast defining a drilling path, comprising:

providing a holder for holding a plurality of drilling elements;

using a first drilling element from the carousel to form a starter borehole;

withdrawing the first drilling element from the starter borehole;

returning the first drilling element to the holder;

inserting a second drilling element from the holder at least partially into the starter borehole;

after the inserting step, associating the second drilling element with the drill head; and advancing the second drilling element into the starter borehole to form the finished borehole.

7. The method of claim 6, further comprising:

inserting a bolt at least partially into the finished borehole; and advancing the drill head along the mast to advance the bolt into the finished borehole.

8. The method of claim 7, wherein the step of withdrawing the drill head from a drilling path aligned with the mast precedes the step of inserting the bolt.

9. The method of claim 8, further including the step of returning the drill head to the drilling path before the advancing step.

10. The method of claim 6, wherein the holder comprises a carousel, and further including the step of rotating the carousel to present the drilling elements to a manipulator for associating the drilling elements with the drill head.

11. A module for use in drilling a borehole in face of a mine passage, comprising:

a manipulator;

a carousel including a rotatable body carrying a first holder for holding a first drilling element having a first bit and a second holder for holding a second drilling element having a second bit, wherein the body may be rotated to present either the first drilling element or the second drilling element for insertion in the drill head for forming the borehole; and a mast carrying a drill head and a drill guide having a passage for receiving the drilling elements;

wherein the manipulator serially delivers the drilling elements from the carousel to the drill head to form the borehole through the passage and returns the drilling elements to the carousel.

12. The module of claim 11, further including a bolt magazine comprising a frame, first and second spaced guides supported by the frame for receiving the plurality of bolts, each guide including an infeed end and a delivery end, and an arm pivotally mounted relative to the frame for engaging at least one bolt received in the guides, the arm being biased toward the delivery end of the guides, wherein the manipulator delivers at least one of the roof bolts to the drill head for installation in the borehole.

13. The module of claim 11, wherein the manipulator comprises:

an arm extending in a radial direction relative to a pivot point about which the arm is pivotally mounted for movement along a generally arcuate path, the arm carrying a pair of generally opposed jaws pivotally mounted for moving between a first, closed position for gripping an object placed in close proximity to an end face of the arm and a second, open position for passing the object without any interference as the arm moves through the arcuate path and without moving in the radial direction.

14. The module of claim 11, wherein the drill guide includes:

a pair of pivotally mounted arms, at least one of the arms includes a first part extending in a first plane and intersecting a first axis, a second offset part extending in a second plane generally parallel to the first plane and intersecting a second axis spaced from the first axis, and a third part connecting the first and second parts.

15. The module of claim 11, further including:

a stab jack actuated by a cylinder including a fluid under pressure for engaging the mine face to fix the position of the module relative to the mine passage;

a sensor for sensing the pressure of the fluid associated with the cylinder and generating an output signal; and a controller for automatically advancing the stab jack to engage the mine face based on a change in the output signal.

16. The module of claim 11, further including computer-implemented means for causing the drill head, upon receiving a single user input signal, to use the drilling elements to form the borehole.

17. The module of claim 11, further including:

a first user interface including a display for displaying at least one component of the module, wherein the display visualizes the movement of the component during the drilling or bolting operation.

18. The module of claim 11, further including means for detecting contact between the face and one of the drilling elements or the drill guide.

19. The module of claim 11, further comprising:

means for detecting contact between the first drilling element and the face; and means for initiating a collaring routine if an output from the detecting means indicates a lack of solid contact.

20. A method of forming a finished borehole in a face using a drill head for advancing along an elongated mast defining a drilling path aligned with the mast, comprising:

using a first drilling element to form a starter borehole;

withdrawing the first drilling element from the starter borehole;

inserting a second drilling element at least partially into the starter borehole;

advancing the second drilling element into the starter borehole and forming the finished borehole;

withdrawing the drill head from the drilling path;

after withdrawing the drill head from the drilling path, inserting a bolt at least partially into the finished borehole by advancing the drill head along the mast to advance the bolt into the finished borehole.

21. The method of claim 20, further including the step of returning the drill head to the drilling path before the step of inserting the bolt.

22. A module for use in drilling a borehole in face of a mine passage, comprising:

a bolt magazine comprising a frame, first and second spaced guides supported by the frame for receiving the plurality of bolts, each guide including an infeed end and a delivery end, and an arm pivotally mounted relative to the frame for engaging at least one bolt received in the guides, the arm being biased toward the delivery end of the guides, wherein the manipulator delivers at least one of the roofbolts to the drill head for installation in the borehole;

a manipulator;

a carousel including a rotatable body carrying a first holder for holding a first drilling element having a first bit and a second holder for holding a second drilling element having a second bit, wherein the body may be rotated to present either the first drilling element or the second drilling element for insertion in the drill head for forming the borehole; and a mast carrying a drill head and a drill guide having a passage for receiving the drilling elements;

wherein the manipulator serially delivers the drilling elements from the carousel to the drill head to form the borehole through the passage, returns the drilling elements to the carousel, and retrieves at least one bolt from the bolt magazine for insertion in the borehole.

23. The module of claim 22, wherein the manipulator comprises:

an arm extending in a radial direction relative to a pivot point about which the arm is pivotally mounted for movement along a generally arcuate path, the arm carrying a pair of generally opposed jaws pivotally mounted for moving between a first, closed position for gripping an object placed in close proximity to an end face of the arm and a second, open position for passing the object without any interference as the arm moves through the arcuate path and without moving in the radial direction.

24. The module of claim 22, wherein the drill guide includes:

a pair of pivotally mounted arms, at least one of the arms includes a first part extending in a first plane and intersecting a first axis, a second offset part extending in a second plane generally parallel to the first plane and intersecting a second axis spaced from the first axis, and a third part connecting the first and second parts.

25. The module of claim 22, further including:

a stab jack actuated by a cylinder including a fluid under pressure for engaging the mine face to fix the position of the module relative to the mine passage;

a sensor for sensing the pressure of the fluid associated with the cylinder and generating an output signal; and a controller for automatically advancing the stab jack to engage the mine face based on a change in the output signal.

26. A method of forming a finished borehole in a face using a drill head for advancing along an elongated mast defining a drilling path aligned with the mast, comprising:

drilling a starter borehole with a first drilling element;

withdrawing the first drilling element from the starter borehole;

inserting a second drilling element at least partially into the starter borehole;

after the inserting step, associating the second drilling element with the drill head; and forming the finished borehole using the second drilling element.

27. The method of claim 26, further including the step of providing the first drilling element with a first drill bit and the second drilling element with a second drill bit.

28. The method of claim 26, further including the step of inserting a bolt into the finished borehole.

29. A module for use in drilling in a face of a mine passage, comprising:

a first holder for holding a first drilling element having a first bit;

a second holder for holding a second drilling element having a second bit, a mast carrying a drill head for receiving the drilling elements;

a manipulator for delivering the first drilling element to the drill head to form a starter borehole and inserting the second drilling element in the starter borehole once formed.

* * * * *